US006994184B2

(12) United States Patent
Latimer et al.

(10) Patent No.: US 6,994,184 B2
(45) Date of Patent: Feb. 7, 2006

(54) STOWABLE LADDER CONFIGURED FOR INSTALLATION IN AN OPENING

(75) Inventors: Brett A. Latimer, New Castle, PA (US); Ronald K. Burig, New Castle, PA (US); Christine A. Brown, Jamestown, PA (US); David E. Plotner, Sharpsville, PA (US); John J. Fiumefreddo, New Wilmington, PA (US); Roy B. Bendickson, Sharpsville, PA (US)

(73) Assignee: Werner Co., Greenville, PA (US)

( * ) Notice: Subject to any disclaimer, the term of this patent is extended or adjusted under 35 U.S.C. 154(b) by 140 days.

(21) Appl. No.: 10/733,765

(22) Filed: Dec. 12, 2003

(65) Prior Publication Data

US 2005/0029044 A1 Feb. 10, 2005

Related U.S. Application Data

(63) Continuation-in-part of application No. 10/635,897, filed on Aug. 7, 2003.

(51) Int. Cl.
*E06C 9/00* (2006.01)
*E04G 3/00* (2006.01)

(52) U.S. Cl. ..... 182/77; 182/95; 182/97

(58) Field of Classification Search ..... 182/78, 182/79, 86, 96, 98, 159, 160, 88, 207, 220, 182/209, 80, 81, 163, 77, 97, 95, 93; 49/340, 49/141

See application file for complete search history.

(56) References Cited

U.S. PATENT DOCUMENTS

| | | | | |
|---|---|---|---|---|
| 740,460 | A * | 10/1903 | Naylor | 182/159 |
| 2,649,273 | A | 8/1953 | Bjorklund et al. | |
| 2,852,176 | A | 9/1958 | Harmon | |
| 3,051,261 | A * | 8/1962 | Webb, Sr. et al. | 182/78 |
| 3,169,603 | A * | 2/1965 | Amic, Sr. | 182/78 |

(Continued)

FOREIGN PATENT DOCUMENTS

| | | |
|---|---|---|
| AT | 004 864 U1 | 12/2001 |
| CH | 636 166 A5 | 5/1983 |

*Primary Examiner*—Hugh B. Thompson, II
(74) *Attorney, Agent, or Firm*—McDermott Will & Emery LLP

(57) ABSTRACT

A folding ladder is configured for installation in an opening to provide access between one floor or space and another floor or space. The folding ladder includes, in one aspect, an upper ladder section having a left ladder rail and a right ladder rail, a lower ladder section having a left ladder rail and a right ladder rail, a hinge rotatably connecting the upper ladder section ladder rails to the lower ladder section ladder rails, and a plurality of steps rotatably disposed between the upper and lower ladder rails. The plurality of steps are configured for rotation between a retracted position and a deployed position. At least one step disposed between the upper ladder rails and at least one step disposed between the lower ladder rails are linked by at least one linkage member so that each of the noted steps rotates between a retracted position and a deployed position upon rotational movement of the upper ladder section relative to the lower ladder section between a closed position and an open position.

11 Claims, 31 Drawing Sheets

U.S. PATENT DOCUMENTS 4,016,954 A * 4/1977 Hickman ..... 182/160
4,281,743 A 8/1981 Fuller
4,541,508 A * 9/1985 Lundh ..... 182/78
4,560,030 A * 12/1985 Mucelli ..... 182/160
4,723,631 A 2/1988 Tremblay
4,757,876 A 7/1988 Peacock
4,815,564 A * 3/1989 Yoo ..... 182/160
5,111,906 A * 5/1992 Abadia ..... 182/79
5,195,610 A * 3/1993 Chang ..... 182/156
5,685,394 A * 11/1997 Simson ..... 182/159
5,967,257 A * 10/1999 Begin et al. ..... 182/96
6,802,393 B2 * 10/2004 Zheng ..... 182/159
6,866,118 B1 * 3/2005 Battenberg ..... 182/77
6,886,661 B1 * 5/2005 Battenberg ..... 182/77

* cited by examiner

STOWABLE LADDER CONFIGURED FOR INSTALLATION IN AN OPENING

CROSS REFERENCE TO RELATED APPLICATIONS

This application is a continuation-in-part of, and claims priority to, U.S. patent application Ser. No. 10/635,897, filed Aug. 7, 2003, which is hereby incorporated by reference in its entirety. The filing of this continuation-in-part application is not an admission that any of the matter disclosed herein constitutes new matter and shall not prejudice any later claims to priority of subject matter in the aforementioned U.S. patent application Ser. No. 10/635,897.

TECHNICAL FIELD

The disclosure relates generally to a stowable ladder configured for installation in an opening, such as an opening in a ceiling of a house (e.g., attic ladder), an opening in a ceiling of a building floor, or an opening to a suspended storage space (e.g., an elevated garage storage area) to provide temporary access between one floor or space and another floor or space.

BACKGROUND

Examples of stowable ladders, attic ladders, "disappearing stairways" and the like are shown, for example, in U.S. Pat. Nos. 2,649,237 and 2,852,176. Such ladders normally fold and retract upwardly into a frame secured between adjacent joists of the attic, and the folded ladder is covered by a door or panel which normally extends substantially flush with the finished ceiling of the room in which the ladder is mounted. These ladders are thus configured to take up no floor space except when actually extended and are also inexpensive to construct, as compared with fixed stairways typically constructed on-site.

U.S. Pat. No. 4,281,743 issued to Fuller on Aug. 4, 1981 shows another conventional attic ladder. As shown in FIG. 1 attic ladder 11 includes an outside frame 12 which is mounted between adjacent floor joists 13 of the attic floor 14. Cross braces 15 are mounted between a pair of adjacent floor joists 13 to provide end support for the frame 12 of the disappearing stairway. Ladder 11 is mounted in the ceiling by securing frame 12 to the joists 13 and the cross braces 15. A cover panel 16 forms part of ladder 11 and is hinged to the outer frame 12, so that the door becomes substantially flush with the ceiling 17 when the ladder 11 is folded. A first ladder portion 17 is affixed to the inner face of cover panel 16 and a second ladder portion 18 is pivotally hinged to the first ladder portion so as to be unfolded or folded when the ladder is opened or closed. While commercially available attic ladders or disappearing stairways typically come in a number of sizes, most come in several standard widths and lengths adaptable to fit conventional constructions.

U.S. Pat. No. 4,541,508 issued to Lundh on Sep. 17, 1985 shows yet another conventional attic ladder. In FIG. 2, a foldable ladder is shown to consist of a lower section 11, a central section 12 and an upper section 13. The central section 12 is hingedly connected to the two remaining sections 11,13 by a hinge so that the central section 12 and the lower section 11 can be folded up on the upper section 13. Upper section 13 is hingedly attached to a frame 14 by hinges 15, with the folding down movement of the upper ladder section 13 being limited by a pair of toggle joints 16,17, attached to the upper ladder section and to the frame 14. Toggle joints 16,17 are rigidly connected to each other at the lower arms by means of an axle 18 extending in parallel with the rungs of the ladder and are attached to the axle outside the side rails of the ladder. The ladder is spring-biased to a closed position by a gas spring 19 connected at one end to an outside of one side rail and connected at its other end, via piston rod 19*a*, to moment arm 18*a*, which is rigidly connected to the axle 18 at such an angle that a maximum moment is generated when the door is almost entirely closed. When the point of connection between the gas spring 19 and the moment arm 18*a* has passed the line for moment centre (i.e. the connecting line between the attachment of the gas spring 19 to the ladder 13 and the axle 18, which passing takes place when the door is opened entirely), the gas spring 19 actuates the door so that it is locked in folded-down position, which is necessary because the "weight" of the door decreases as soon as the ladder sections are folded out.

However, despite the above-noted improvements to the attic ladder and disappearing stairway art, additional improvements can be realized in the structure of the attic ladder.

SUMMARY

In one aspect, a foldable ladder configured for installation in an opening to provide access between one floor or space and another floor or space includes an upper ladder section and a lower ladder section, each comprising a left ladder rail and a right ladder rail. A hinge rotatably connects the upper ladder section ladder rails to the lower ladder section ladder rails. A plurality of steps are rotatably disposed between the upper pair of ladder rails and the lower pair of ladder rails and are configured for rotation between a retracted position and a deployed position. At least one step in the plurality of steps rotatably disposed between the upper pair of ladder rails and at least one step in the plurality of steps rotatably disposed between the lower pair of ladder rails are linked together by at least one linkage member. The linkage member causes each of the noted steps to rotate between a retracted position and a deployed position upon rotational movement of the upper ladder section relative to the lower ladder section about the hinge between a closed position and an open position.

In another aspect of the folding ladder, the aforementioned folding ladder additionally requires that the noted step in the plurality of steps rotatably disposed between the upper pair of ladder rails is linked to the remaining plurality of steps rotatably disposed between the upper pair of ladder rails and the noted step in the plurality of steps rotatably disposed between the lower pair of ladder rails is linked to the remaining plurality of steps rotatably disposed between the lower pair of ladder rails. In accord with this configuration, rotation of the noted steps causes a corresponding rotation of a respective one of the remaining plurality of steps rotatably disposed between the upper pair of ladder rails and the remaining plurality of steps rotatably disposed between the lower pair of ladder rails.

Additional advantages will become readily apparent to those skilled in this art from the following detailed description, wherein only preferred aspects of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Figure 1:
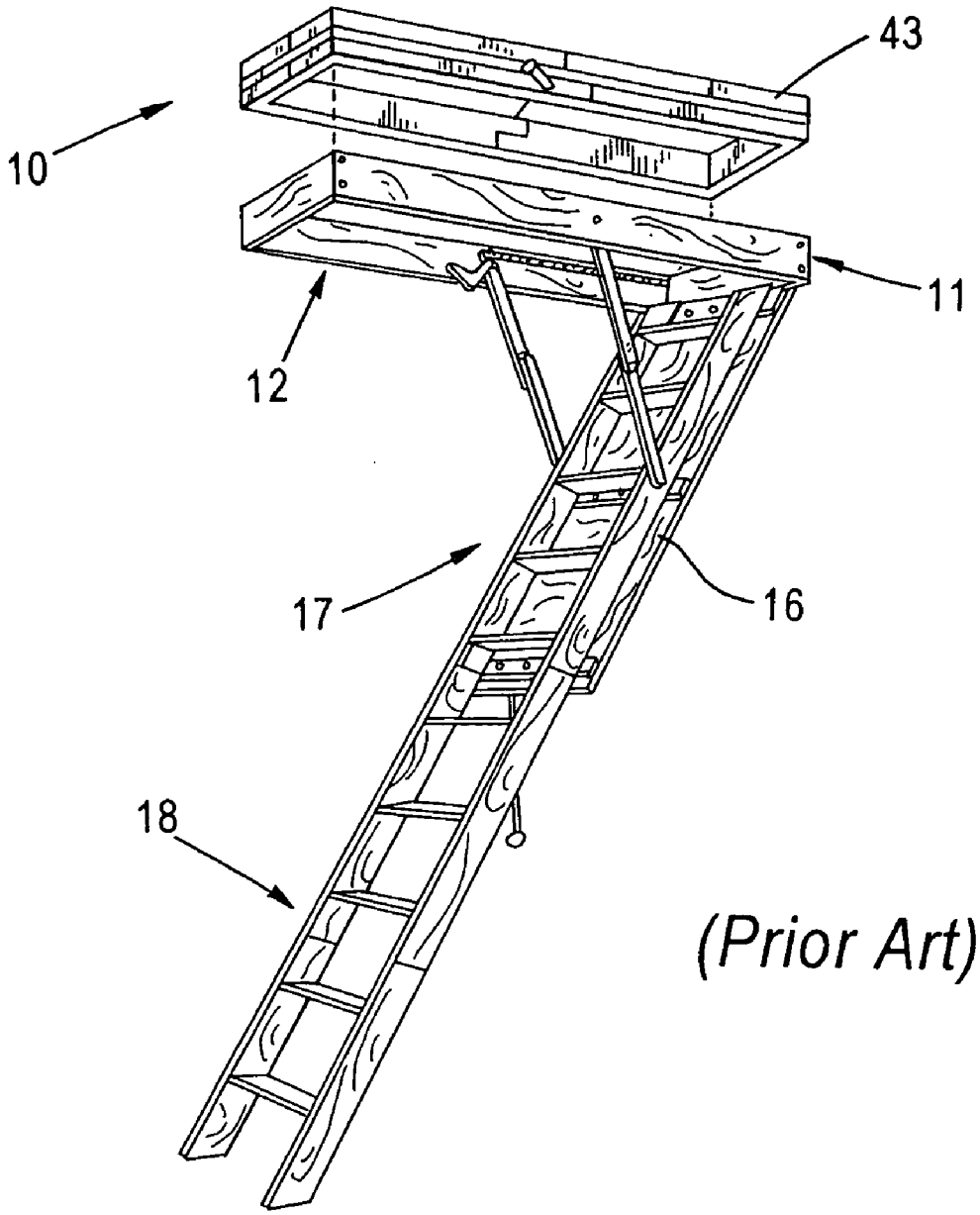
FIG. 1 is a perspective view of conventional folding ladder disposed in an attic.

With reference to the attached drawings, there is described a folding or stowable ladder configured for installation in an opening, such as an opening in a ceiling of a house (e.g., attic ladder), an opening in a ceiling of a building floor, or an opening to a suspended storage space (e.g., an elevated garage storage area) to provide temporary access between one floor or space and another floor or space.

FIGS. 3–11(*b*) show an example of folding ladder 100 and support frame 200 in accord with the present concepts wherein the ladder sections comprising an upper section 110, middle sections 120 and lower sections 130, 140 are shown in various positions as the folding ladder is unfolded from the support frame. It is to be understood that the concepts expressed herein apply equally to a folding ladder bearing any number of folding sections, including but not limited to two, three, four or more.

Support frame 200 is configured for installation within an opening, as described more fully herein, such as but not limited to openings in a ceiling of a house (e.g., attic ladder), openings in a ceiling of a building floor, or openings to a suspended storage space (e.g., an elevated garage storage area) to provide access between one floor or space and another floor or space. Upper ladder section 110 is secured to an upper side of panel 300 by one or more conventional brackets 301 (see FIG. 15), which may be provided at upper and lower portions of upper ladder section 110. Alternatively, more or fewer brackets could be used. Further, additional conventional means of attachment are considered to be within the present disclosure. For example, upper ladder section 110 may be configured by way of slots, grooves, pins, wires, protrusions, recesses, and/or locking devices to mate with corresponding structures provided in or on an upper surface of panel 300 to prevent undesired relative movement therebetween.

Panel 300 is adapted to rotate relative to support frame 200 and may alternatively be hingedly connected by a conventional hinge arrangement 201 to the support frame, as shown, and/or may simply be connected to the ladder 100, which is configured to rotate with respect to the support frame. In one aspect, the panel 300 is configured to substantially occlude the aforementioned opening when the ladder is in a folded and stowed position (e.g., a 0° angle $\alpha$ between the panel 300 and the support frame 200). Panel 300 may be configured to blend in with the surroundings (e.g., to blend in with a ceiling) for aesthetic reasons. Alternatively, panel 300 may advantageously be configured by way of color, shape, and/or size in distinction to the surroundings so as to draw attention thereto (e.g., fire escape pathway/emergency access panel).

Figure 3:
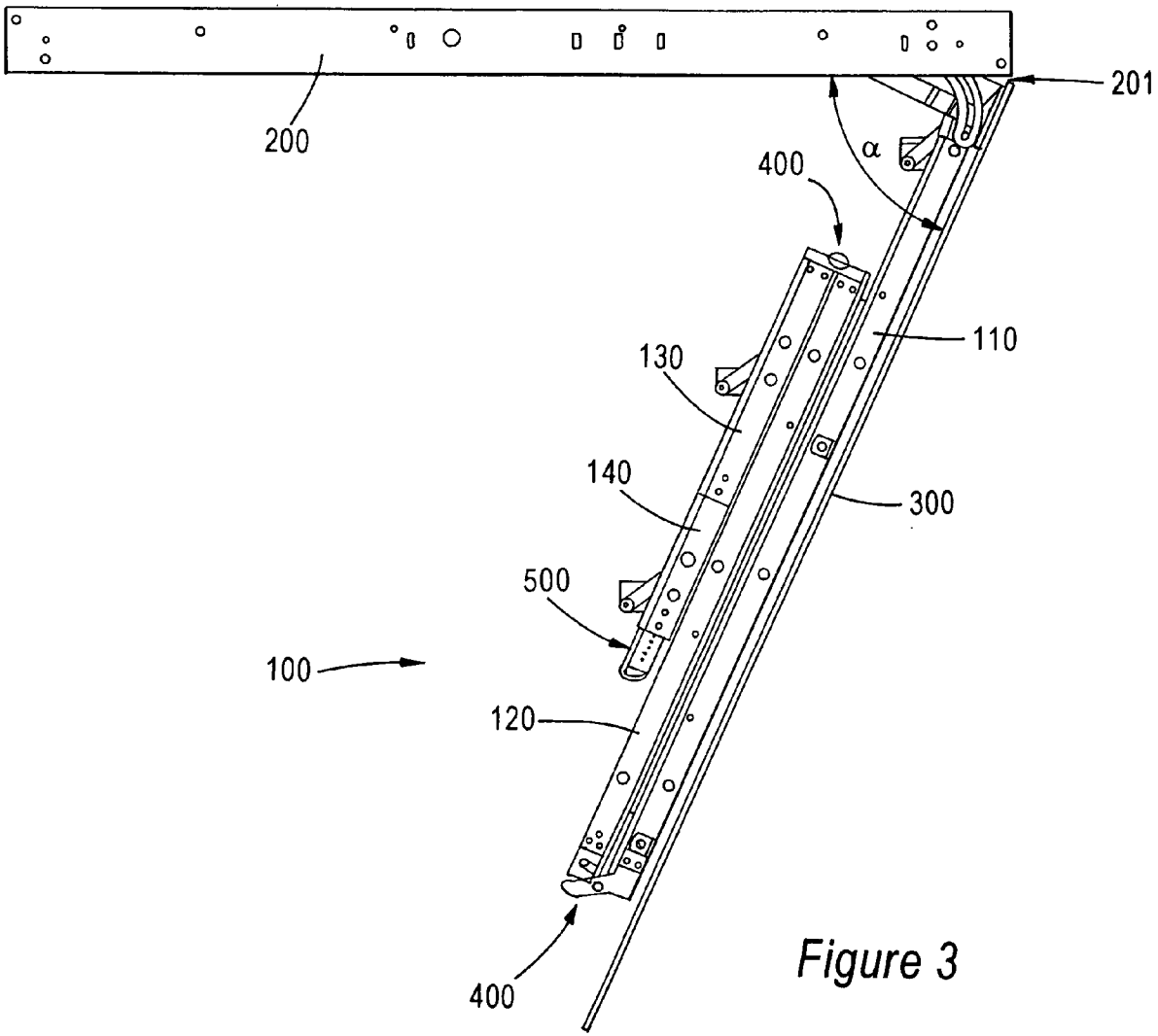
FIG. 3 is a side view of an example of folding ladder and support frame in accord with the present concepts wherein the ladder sections are in a closed position.
Figure 11A:
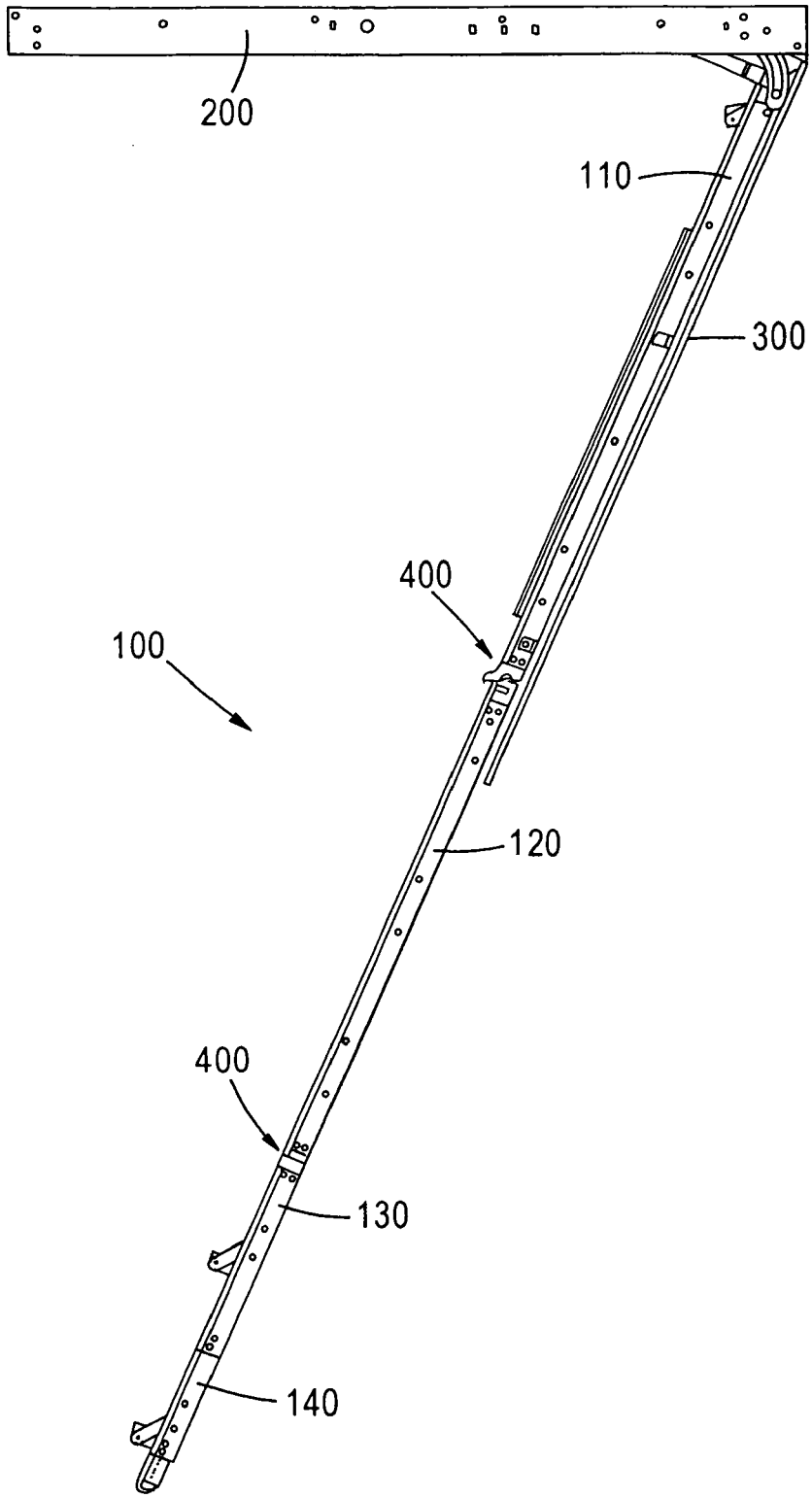
FIGS. 11(*a*)–11(*b*) are, respectively, a side view and a front view of an example of folding ladder and support frame in a fully open position in accord with the present concepts.

Folding ladder 100 may optionally include an adjustable foot 500, an example of which is shown in FIGS. 3 and 11*a*. Conventional residential-use folding ladders are made of wood and the bottom sections of the ladder are cut to an appropriate height during installation to ensure the ladder rails both contact the floor and are co-linear (i.e., no bending of the rails at the joints). Often, for a specified ceiling height, a predetermined length is cut. However, if the floor is even slightly uneven, it is difficult to properly stabilize the ladder using this technique. Adjustable foot 500 may be provided to account for uneven floors or ceilings and different ceiling heights.

Figure 4:
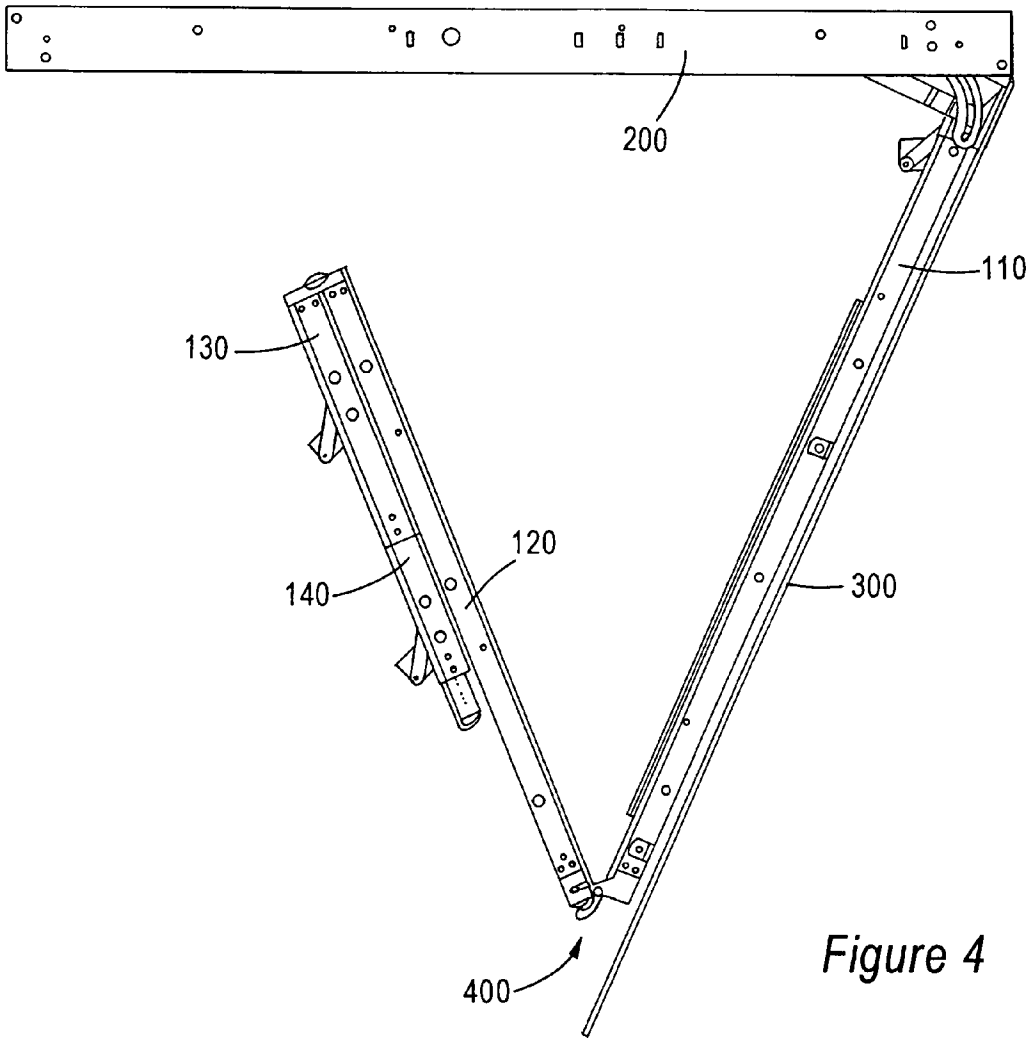
FIG. 4 is a side view of an example of folding ladder and support frame in accord with FIG. 3 wherein a middle ladder section is in a partially open (45°) position.
Figure 5:
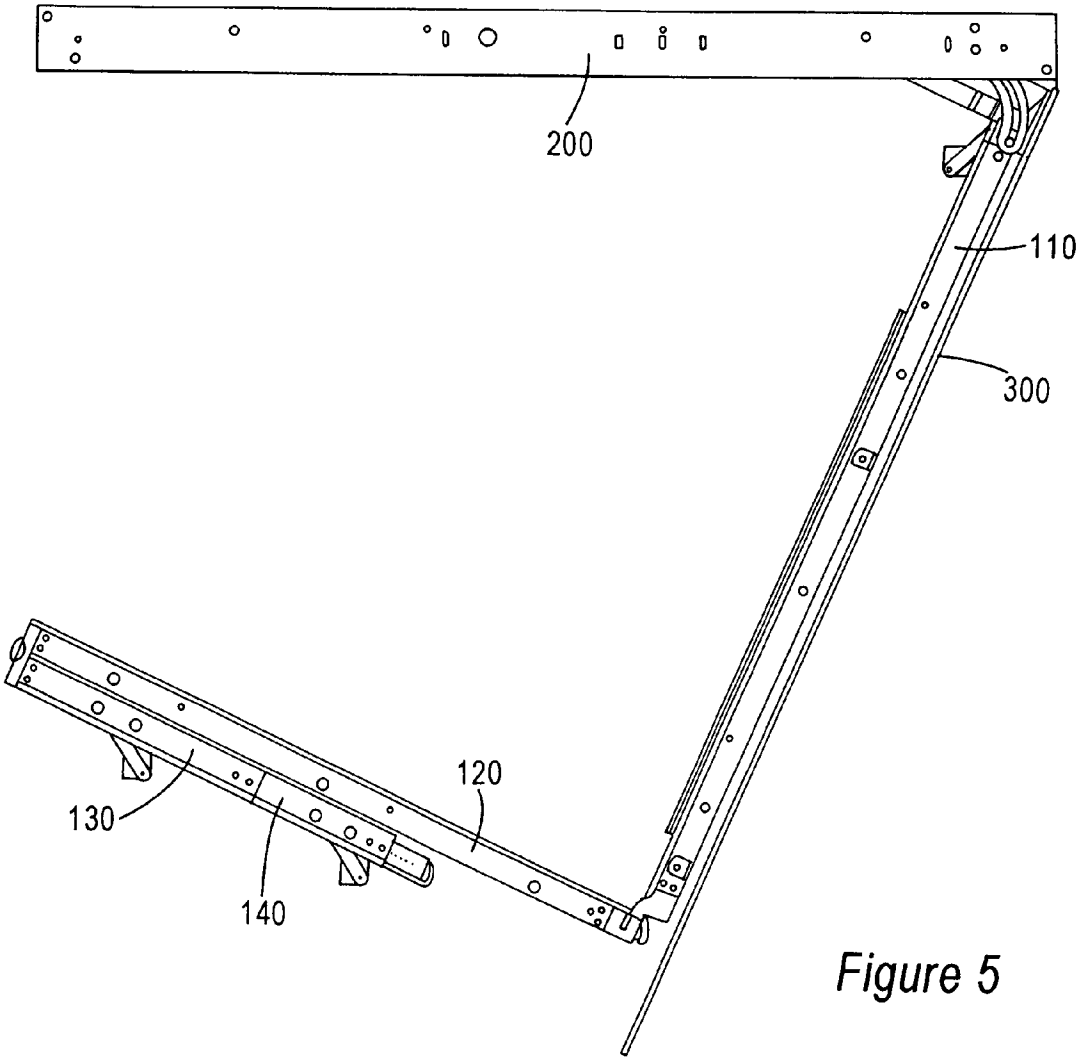
FIG. 5 is a side view of an example of folding ladder and support frame in accord with FIG. 3 wherein a middle ladder section is in a partially open (90°) position.
Figure 6:
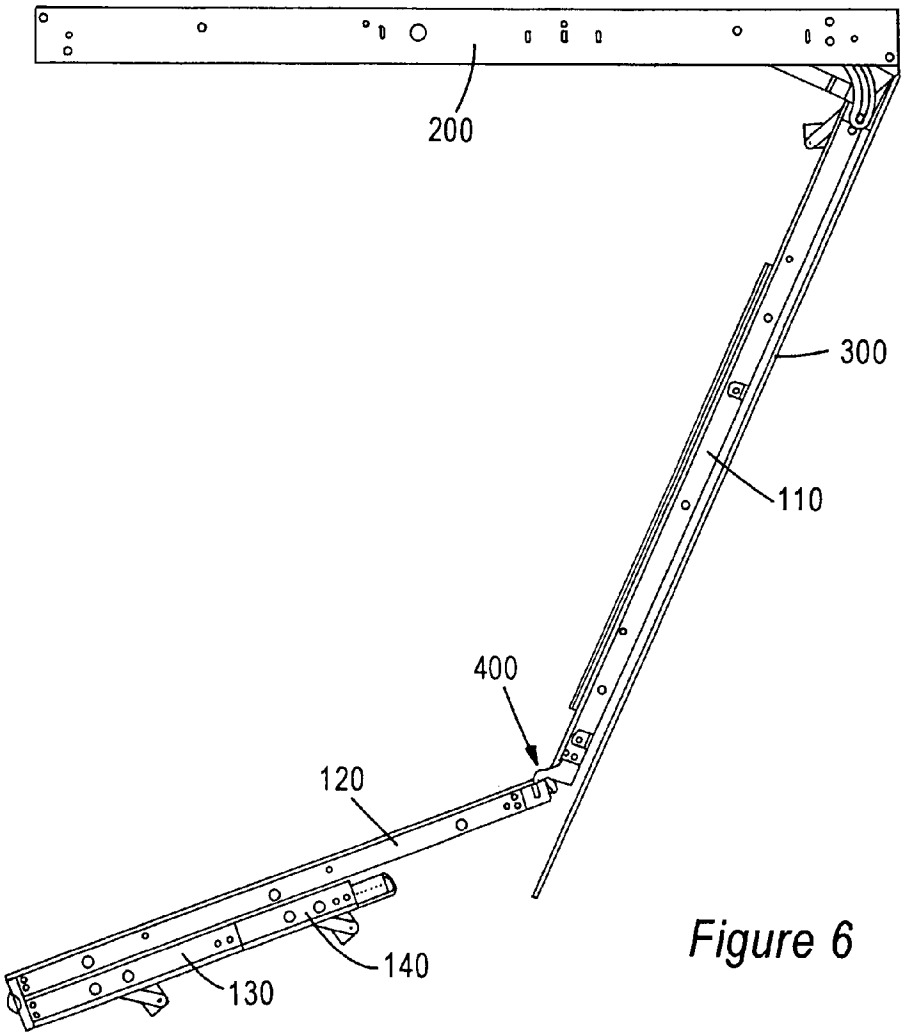
FIG. 6 is a side view of an example of folding ladder and support frame in accord with FIG. 3 wherein a middle ladder section is in a partially open (135°) position.
Figure 7:
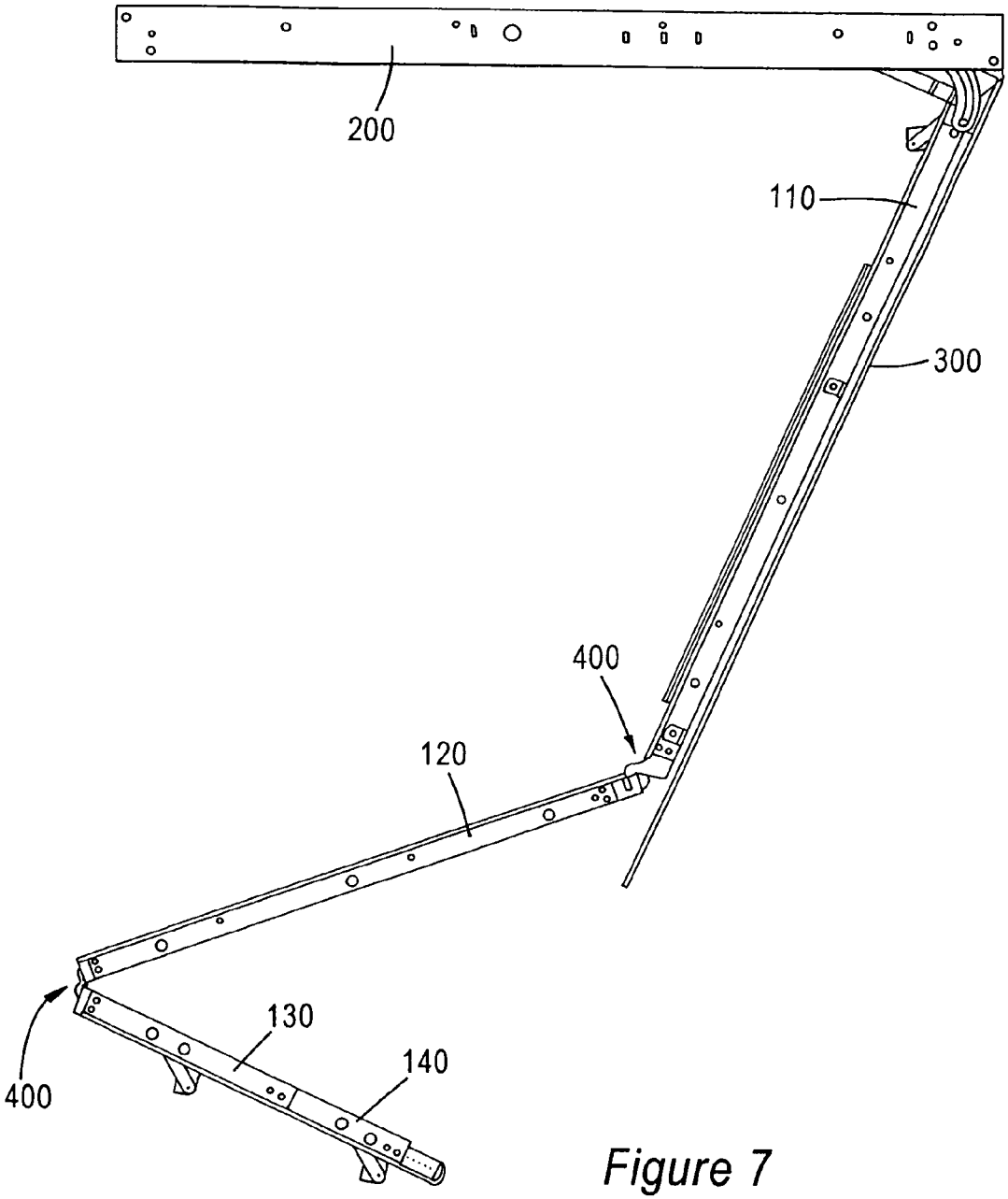
FIG. 7 is a side view of an example of folding ladder and support frame in accord with FIG. 6 wherein a lower ladder section is in a partially open (45°) position.
Figure 8:
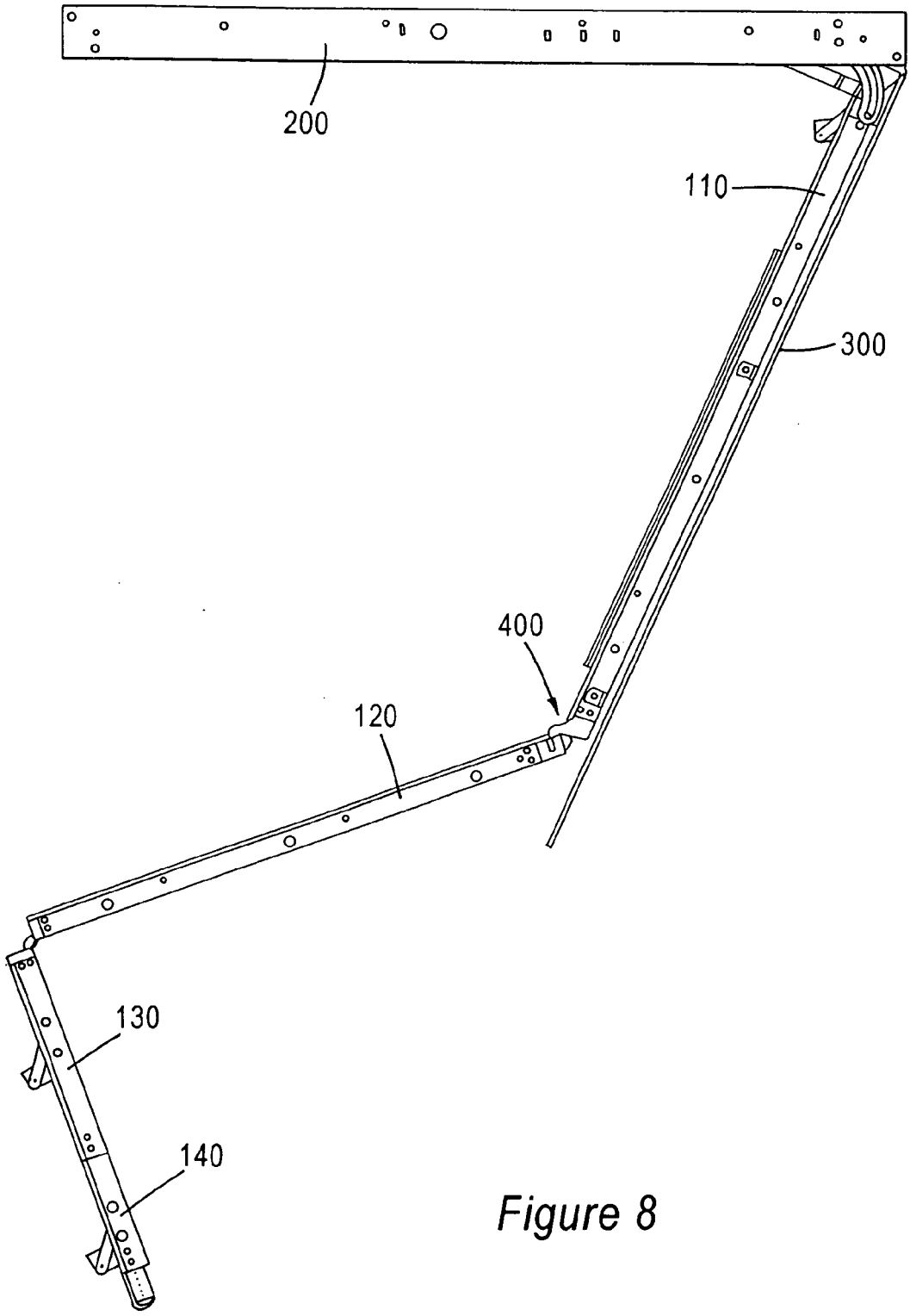
FIG. 8 is a side view of an example of folding ladder and support frame in accord with FIG. 6 wherein a lower ladder section is in a partially open (90°) position.
Figure 9:
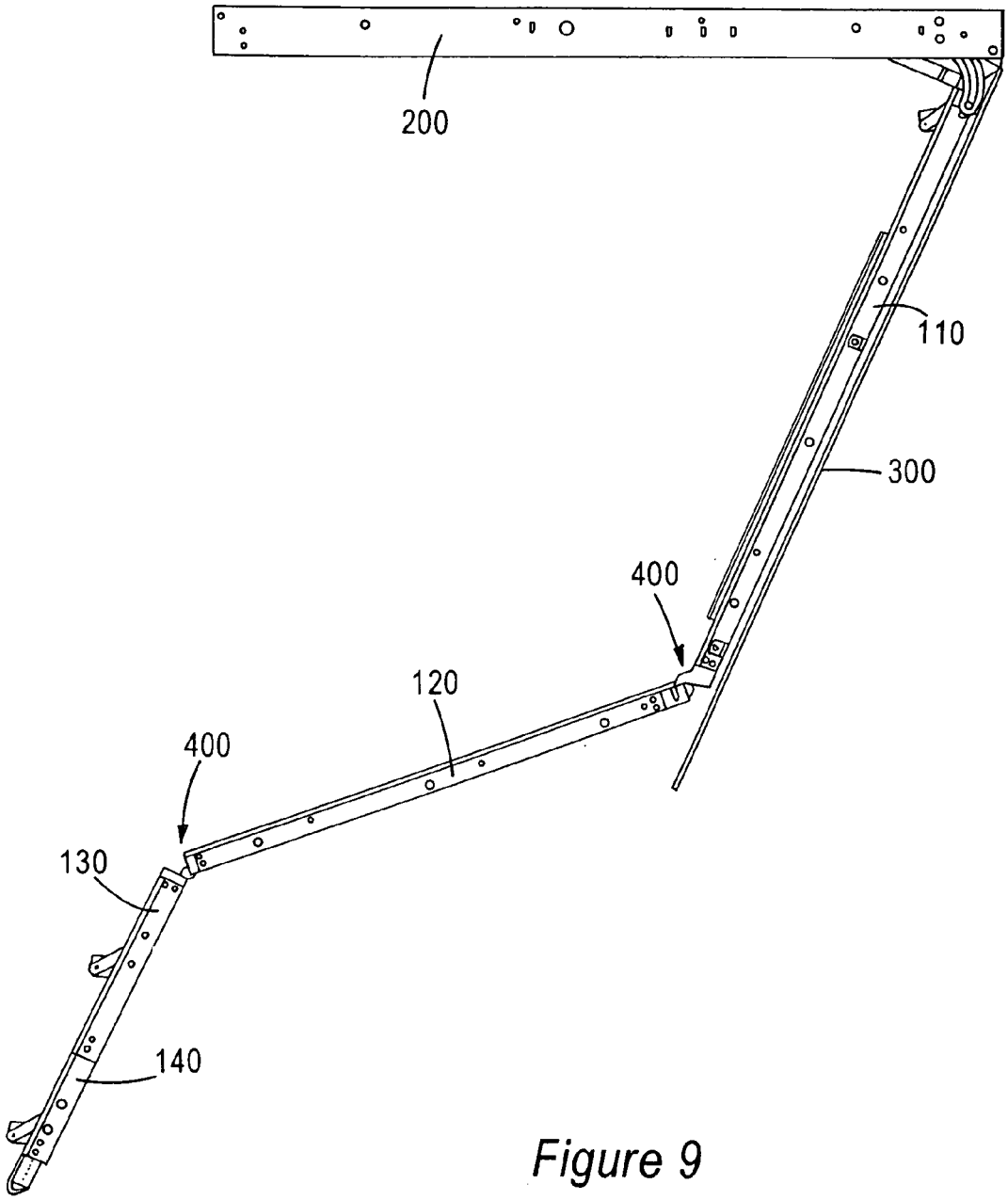
FIG. 9 is a side view of an example of folding ladder and support frame in accord with FIG. 6 wherein a lower ladder section is in a partially open (135°) position.
Figure 10:
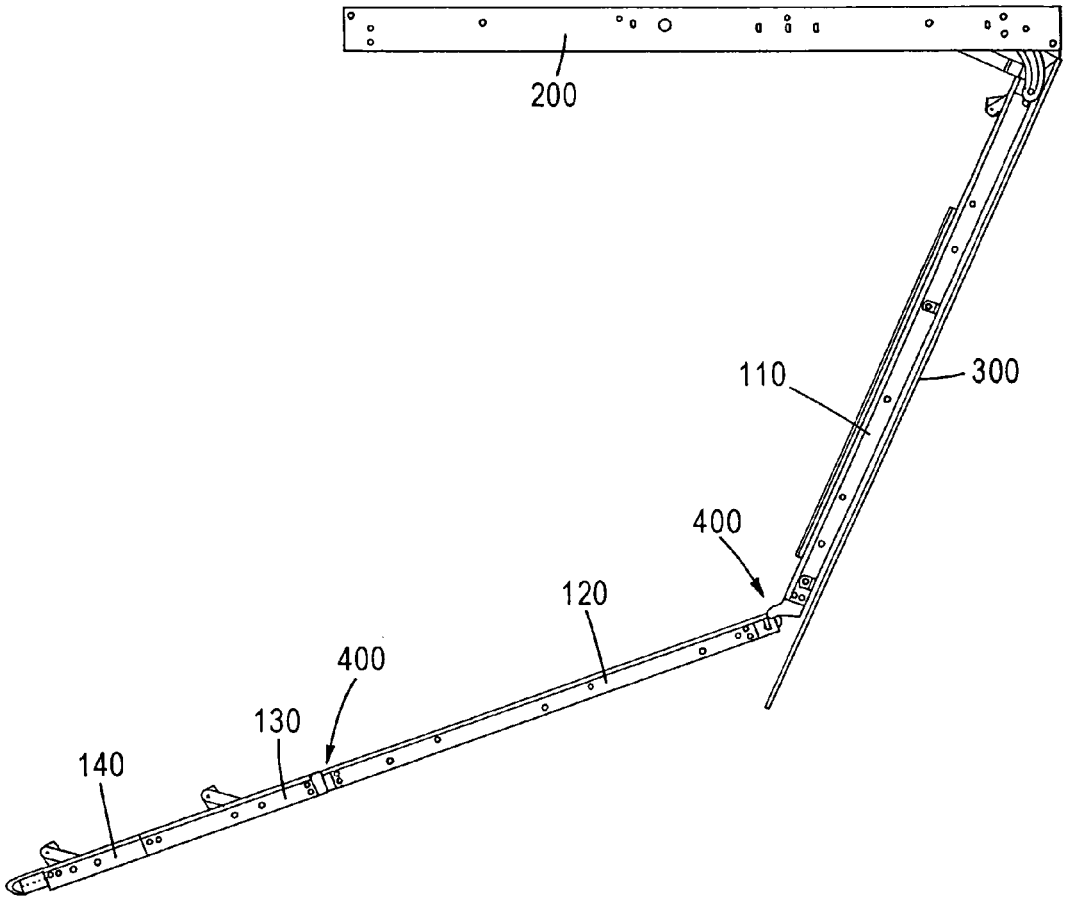
FIG. 10 is a side view of an example of folding ladder and support frame in accord with FIG. 6 wherein a lower ladder section is in a fully open position.
Figure 11B:
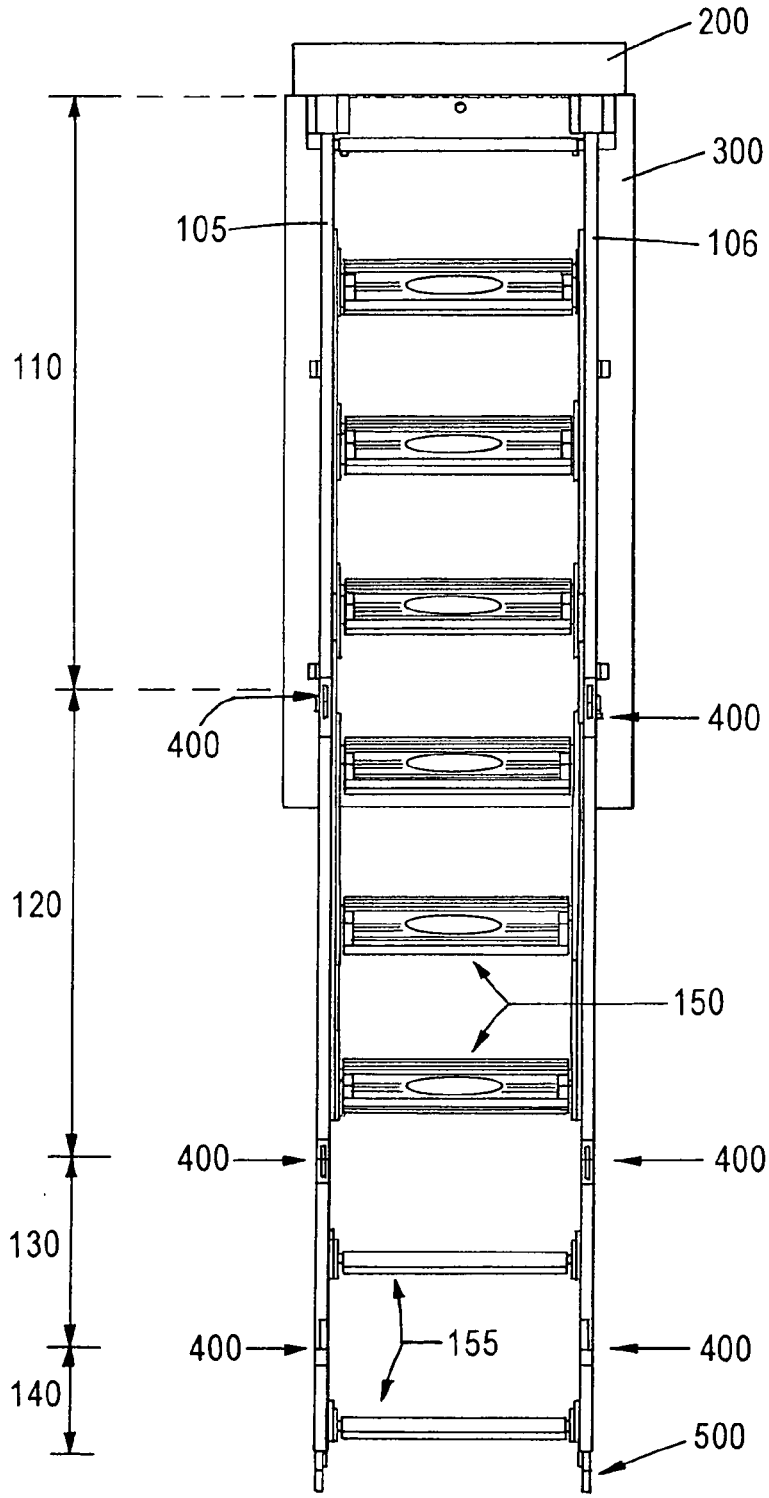

FIGS. 4–6 respectively show the middle ladder section 120 in partially open positions of 45°, 90° and 135°. FIGS. 7–10 respectively show the lower ladder sections 130, 140 in partially open positions of 45°, 90°, 135°, and a fully open position (e.g., 180°), relative to the middle ladder section 120. FIGS. 11(*a*)–11(*b*) respectively show a side view and a front view of the folding ladder 100 in a fully open position, more clearly showing the ladder side rails 105, 106, rotatable steps 150, and fixed steps 155.

Rotation of each ladder section relative to an adjoining section is accomplished by means of a hinge 400, which is broadly defined herein to include any means by which rotation of one element may be had relative to another element and includes, but is not limited to a pin. In one aspect, hinge 400 may optionally comprise a locking hinge and such hinge could be separately provided for each of the paired upper and lower ladder rails (e.g., 110, 120 or 120, 130) or may traverse the width of the ladder, spanning the distance between the left ladder rails 105 and the right ladder rails 106. Each locking hinge 400 could be configured, in a manner known to those or ordinary skill in the art, to lock at one or more predetermined angles β between adjoining ladder sections. For example, hinges 400 could be configured to lock one ladder section (e.g., upper ladder section 110) and another ladder section (e.g., middle ladder section 120) at an angle of 180° (i.e., ladder sections 110, 120 are parallel and co-linear as shown, for example, in FIG. 11(*a*)). Locking hinge 400 may comprise, for example, spring loaded pins mounted in one portion of the hinge adapted to maintain a compressed or loaded state until confronted with a corresponding opening in another portion of the hinge at a predetermined angle β between adjoining ladder sections. Locking hinge 400 may also comprise, for example, a pawl and ratchet that may be activated by default during an opening operation and selectively disengaged during a folding operation.

Hinges 400 may optionally be configured to lock at additional predetermined angles β (e.g., 90°) between adjoining ladder sections to provide, for example, protection against unintentional rapid deployment of the folding ladder. As further protection against unintentional rapid deployment of the folding ladder, the strut itself may be configured to function as a braking mechanism in the opening direction. In another aspect, hinges 400 may advantageously comprise a resistance mechanism to provide increased resistance to opening or closing at various rotational points, in lieu of or in combination with a locking mechanism. A resistance provided by the resistance mechanism could be overcome by application of predetermined levels of force from a user desiring to unfold or fold the folding ladder. One example of a resistance member could include slight protuberances aligned to contact each other or a slight protuberance (e.g., a spring loaded pin) and corresponding recess aligned to mate with each other at one or more specific predetermined angles β between adjoining ladder sections, such that an increased force, above that required to effect the remainder of the relative rotation between the ladder sections, is required to overcome the increased resistance provided by the resistance member at the predetermined angles. The optional resistance members may therefore improve control and stability of the folding ladder 100 during opening and closing operations.

Figure 2:
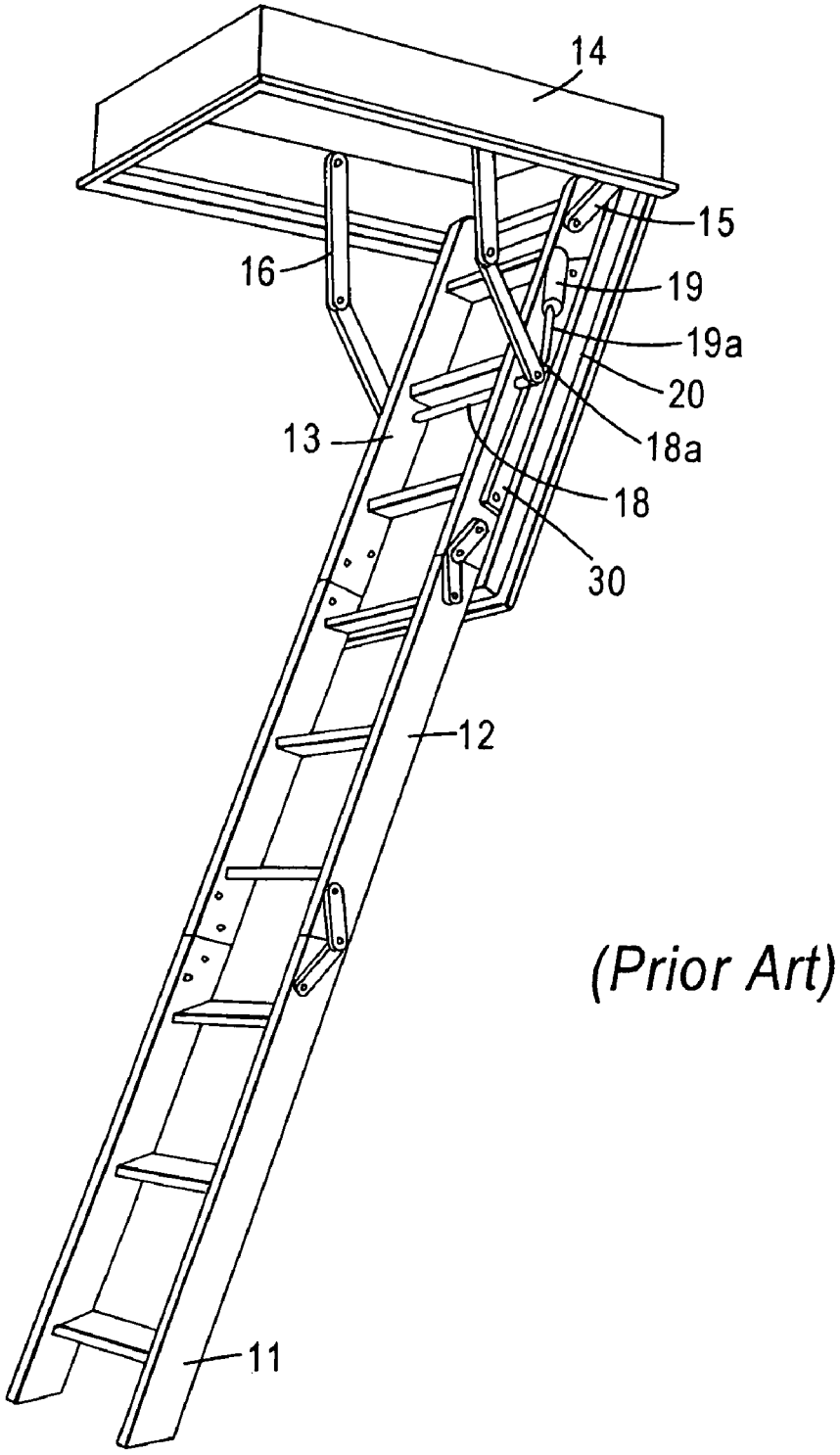
FIG. 2 is a perspective view of another conventional folding ladder disposed in an attic.

A common feature of all current attic ladders is the use of stationary or fixed steps, as shown in FIGS. 1 and 2. While the fixed steps simplify manufacture or assembly and reduce such assembly cost, the fixed steps add to the stack height of the ladder in the ladder's closed or folded position. In the aggregate, the additional stack height and corresponding stack volume limits the amount of product that can be shipped to a customer at one time and similarly limits the amount of product that can be stored on a customers' shelves at one time. In order to alleviate these problems, aspects of the concepts presented herein include a folding ladder 100 design with rotatable steps 150 wherein steps are positioned substantially parallel to an axis of the ladder rails 105, 106 in a closed position and, as the ladder is unfolded for use, the steps would rotate and/or translate into a position that is substantially parallel to a floor or surface against which the bottom of the unfolded ladder rests. Thus, in the retracted position, the steps are positioned so that a front edge of the rotatable steps 150 do not extend appreciably beyond a front edge of the ladder rails 105, 106 and a rear edge of the rotatable steps do not extend appreciably beyond a rear edge of the ladder rails. Configured as illustrated, this extension would be on the order of about 20 mm or less. However, this extension could be increased if the steps in adjoining ladder sections are non-overlapping in the folding state so as to increase the available space for such step extension without adversely affecting the stack height.

The steps 150 thereby provide, in a final position, stable horizontal or substantially horizontal surfaces which may be used to safely ascend or descend the ladder 100. In accord with the concepts expressed herein and the uses to which ladder 100 may be placed, the term substantially horizontal is used as a broad term including any attitude of the step which may feasibly be used for safe ascent or descent of the ladder, which can be influenced by the surface of the step (i.e., high coefficient of friction treatments or surface), and could include steps angled at up to about 20°, although an angle of 5° or less or even 2° or less is preferred.

Figure 12A:
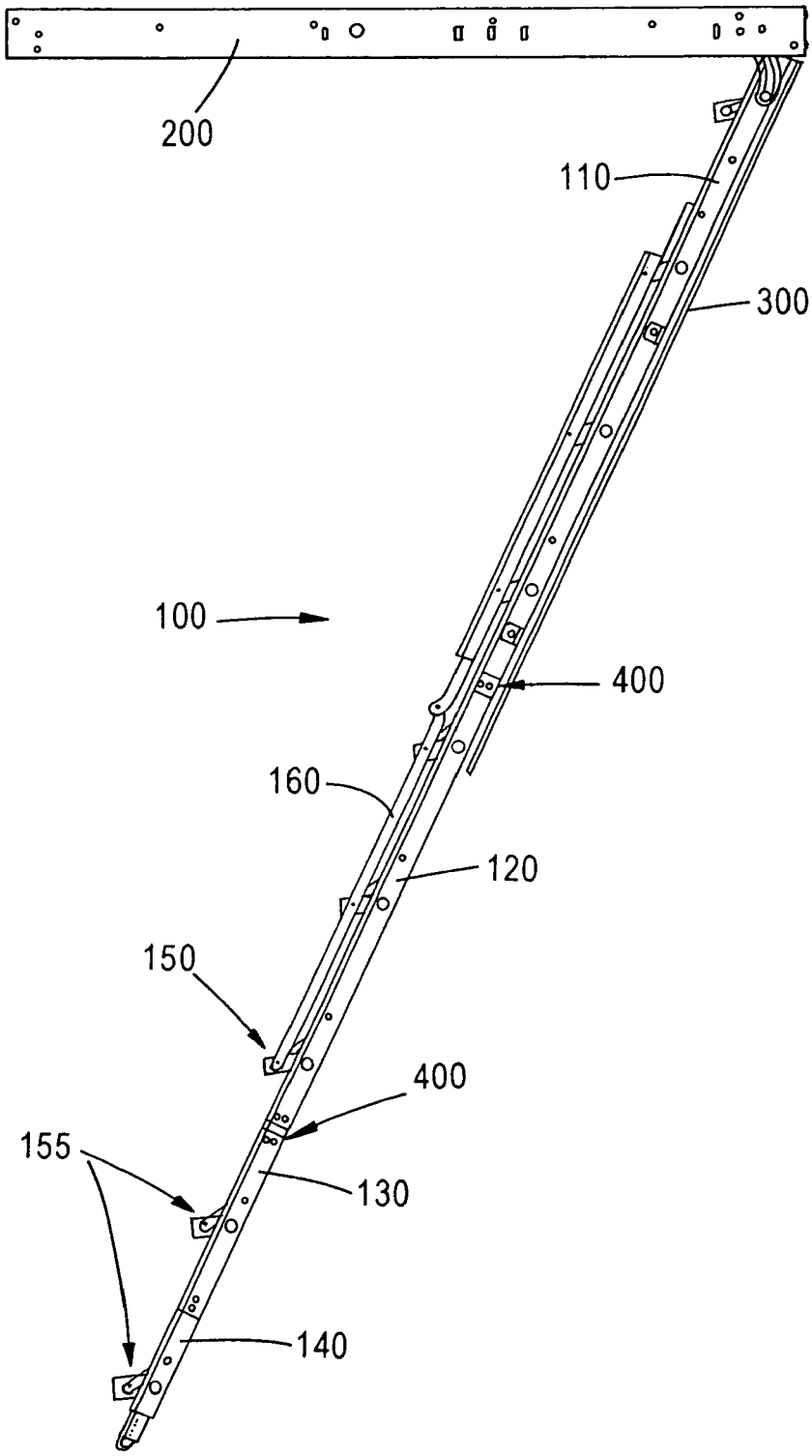
FIGS. 12(*a*)–12(*b*) are, respectively, a side view and a front view of an example of folding ladder and support frame in a fully open position with steps in a partially open (45°) position in accord with the present concepts.
Figure 12B:
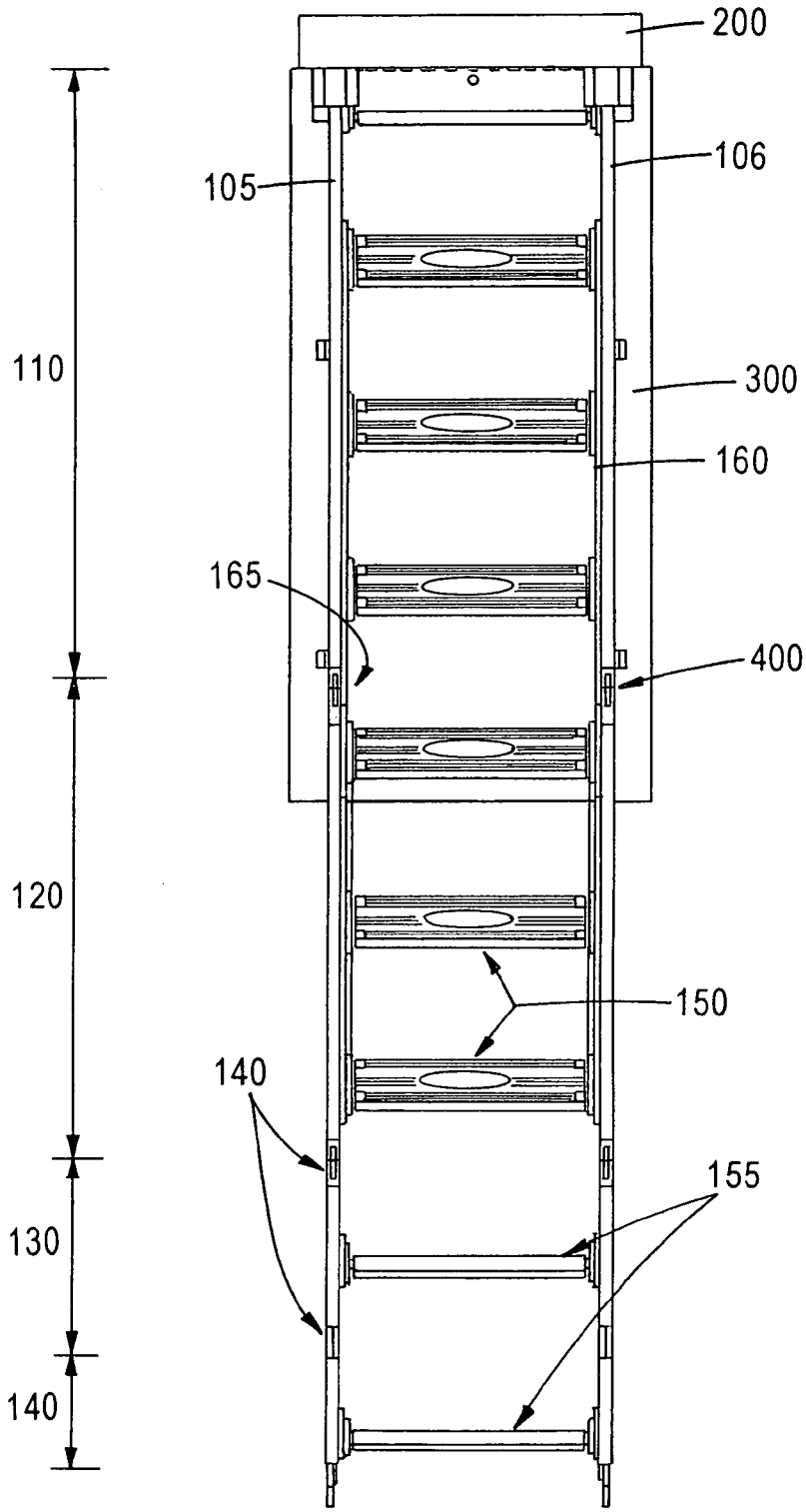
Figure 13:
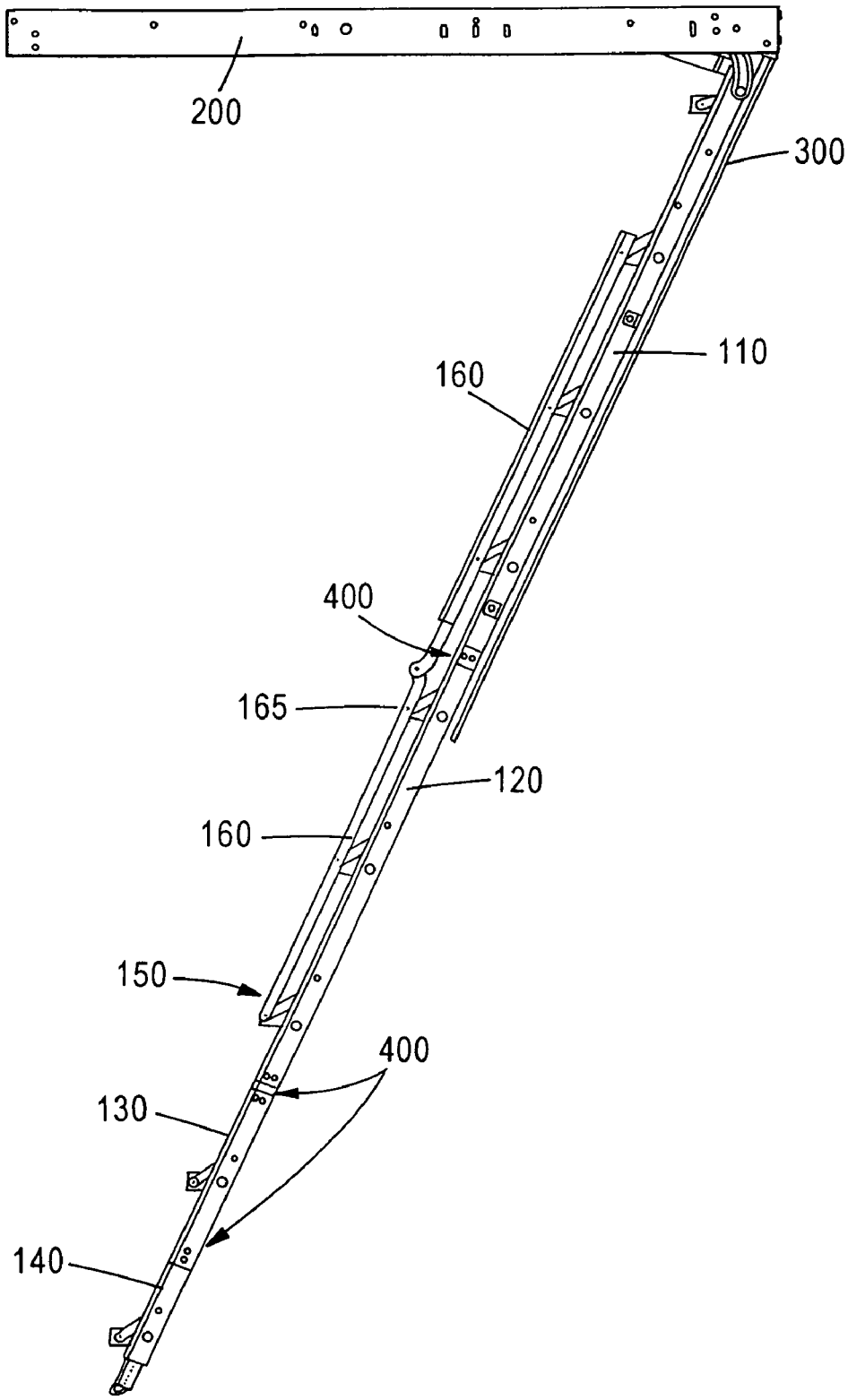
FIG. 13 is a side view of an example of folding ladder and support frame in a fully open position with steps in a partially open (90°) position in accord with the present concepts.
Figure 14A:
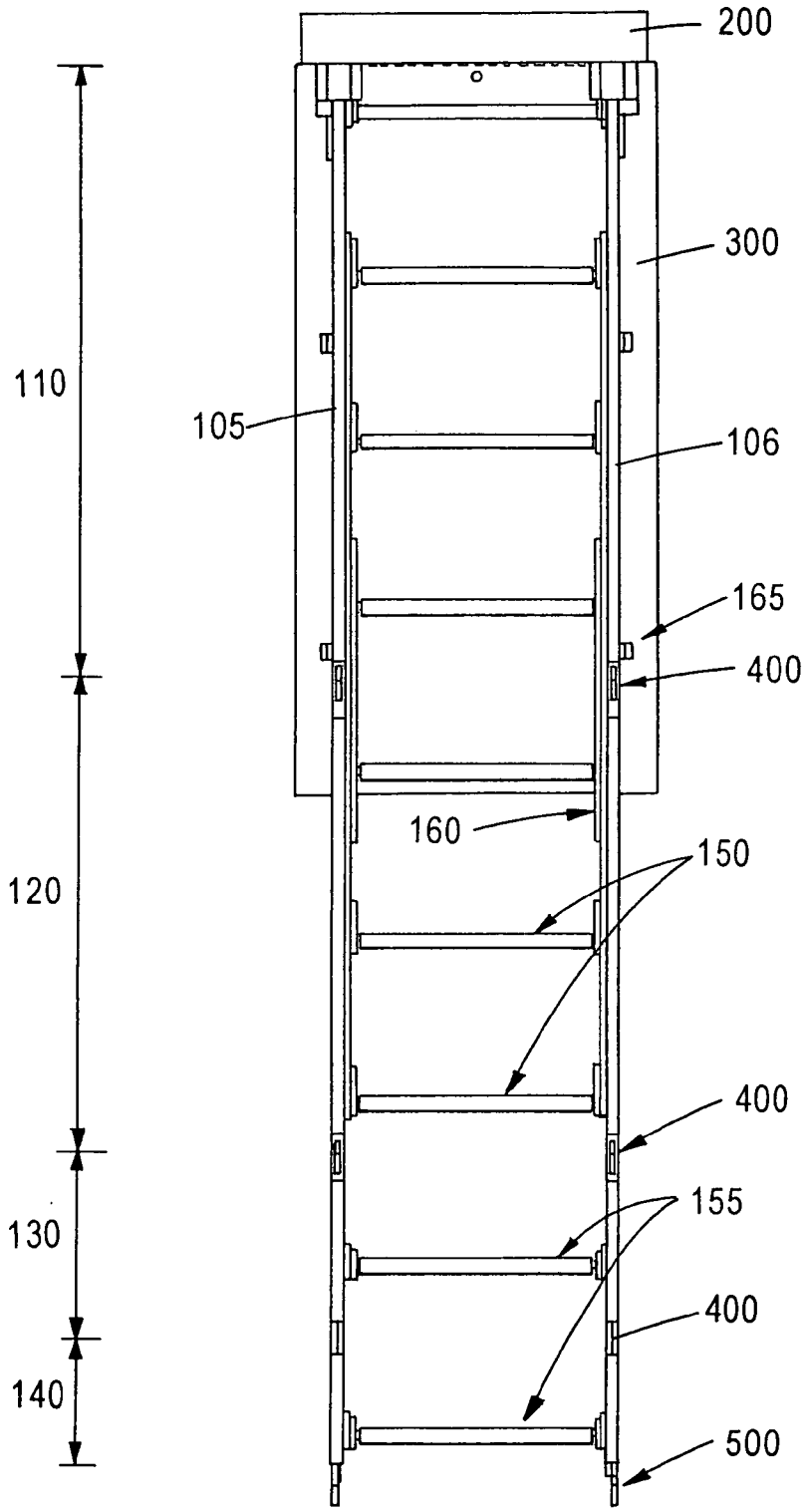
FIGS. 14(*a*)–14(*b*) are, respectively, a front view and a side view of an example of folding ladder and support frame in a fully open position with steps in a fully open position in accord with the present concepts.
Figure 14B:
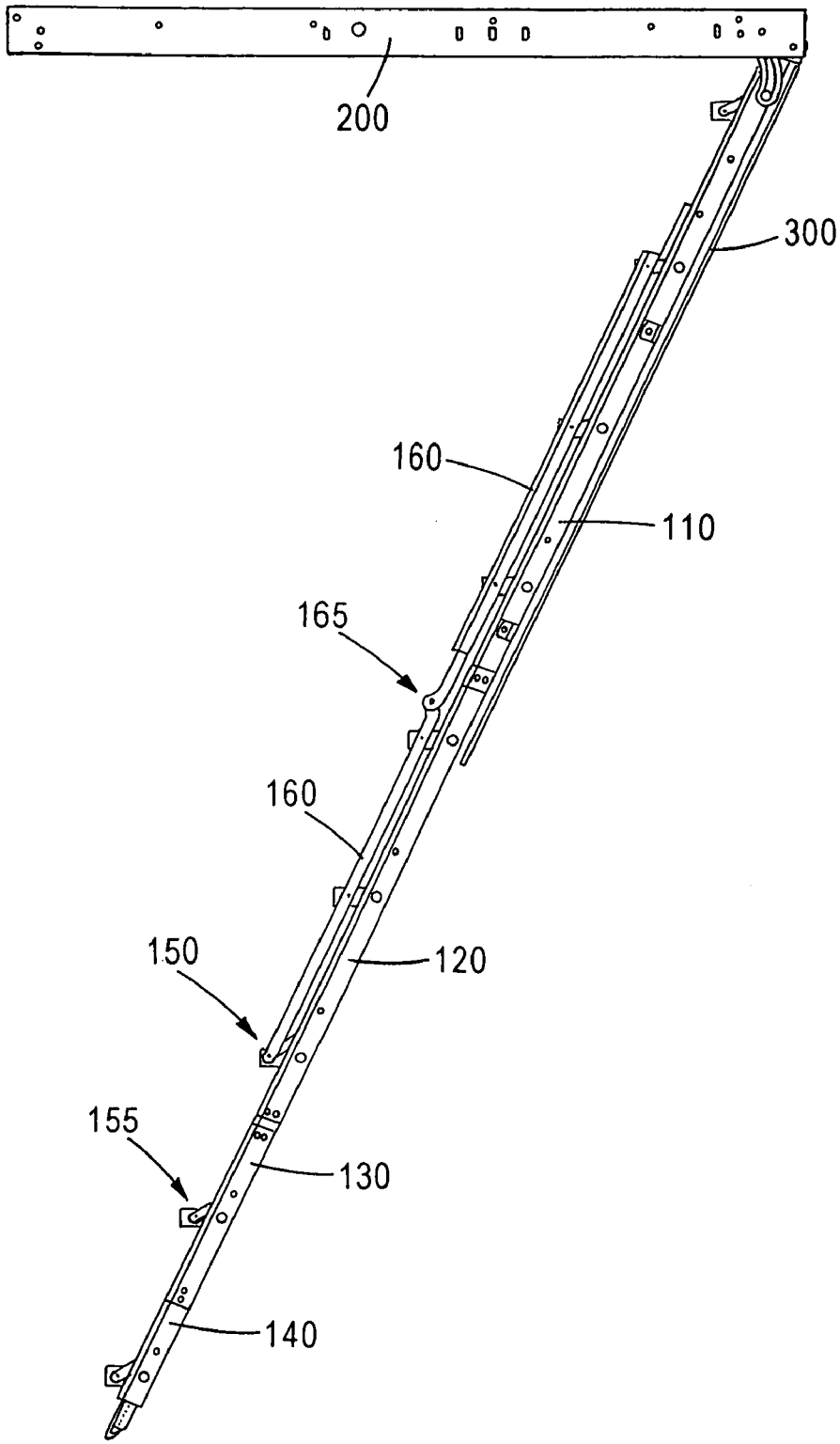

FIG. 11(*b*) shows a front view of one concept of a folding ladder 100 in a fully open position, wherein the rotatable steps 150 are in a retracted or fully closed position, whereas steps 155 are fixed in position. FIGS. 12(*a*)–12(*b*) are, respectively, a side view and a front view of an example of the folding ladder 100 in a fully open position with steps 150 in a partially open (45°) position. FIGS. 13–14 are side views of the folding ladder 100 in a fully open position with steps 150 in a partially open (90°) and fully open position, respectively. Comparison of the front views of FIGS. 11(*b*), 12(*b*), and 14(*a*) show the progression of the opening of the steps 150 from an initial to a final position.

In the example of the folding ladder shown in front view FIG. 11(*b*), a bottom surface of each step 150 is configured to face forwardly in the folded position and the front leading edges of the steps (at a top-most position of the folded steps) are configured to rotate, about a step bar 151, forwardly and downwardly to a final position at least substantially horizontal to the ground. Alternatively, the steps 150 could be configured so that a top or stepping surface of the steps 150 initially faces forward and the front edge of the steps (at a bottom-most position of the folded steps) rotates, about a step bar 151, forwardly and upwardly to a final position at least substantially horizontal to the ground.

Figure 15:
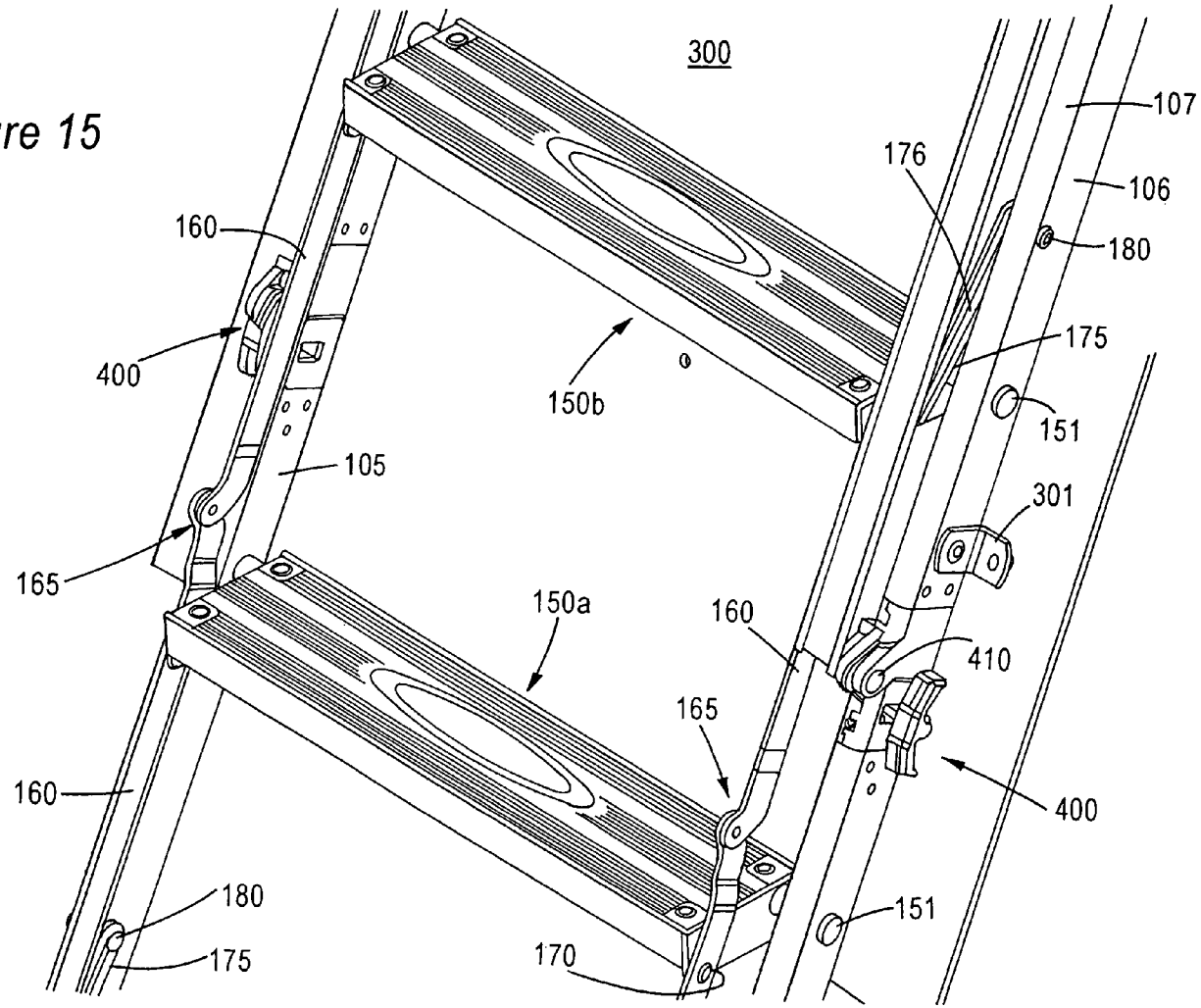
FIG. 15 is a perspective view of an example of a hinge with a locking mechanism for a folding ladder in accord with the present concepts.

As shown more clearly in FIG. 15, a front portion of each of the steps 150 is rotatably connected by joint 170 to a corresponding step rail 160. The step rails 160 are connected to one another at joints 165, which are configured to permit relative rotation between step rails 160 disposed on either side thereof. Joints 165 permit the step rails 160 to be folded over, just as the ladder rails 105, 106 are permitted to be folded over. In the unfolded position with steps 150 deployed, as shown in FIG. 15, the step rail joints 165 are positioned beneath and forward of the ladder rail 105, 106 hinged joints 400. However, when the step rails 106 are rotated upwardly to rotate the steps 150 into the folded position, prior to folding the ladder rails 105, 106, the axes of rotation of joints 165 substantially align with the axes of rotation of the hinges 400 to facilitate folding of the folding ladder 100 while minimizing the stack height. Link members 175 and side rails 160 are configured, in the example illustrated, to travel or reciprocate on an inside of the ladder rails 105, 106 with respect to the widthwise direction. Side rails 160 may optionally be omitted for the step(s) 150 disposed on the ladder 100 lower section 140 as these step(s) may be easily pivoted into a substantially horizontal position by a user, such as by turning the steps 150 with a foot, prior to mounting the ladder.

Alternate configurations of rotatable steps employing conventional rotational connections are also considered within the scope of the present concepts including, but not limited to, pivot joints provided at the connection between the steps and the rails. Additionally, in lieu of the aforementioned configuration wherein a rear portion of each of the steps 150 is rotatably connected to the ladder rails (e.g., 105, 106) via a step bar 151 to permit unfolding of the step in an upward or downward respect, as desired, the step bar or other conventional rotational connection may be provided at the front portion of each of the steps. Still further, the step rail 160 need not necessarily be jointed for folding. The step rails 160 could simply comprise a straight member, such as a rod, bar, or slat, connected to each of the steps in a corresponding ladder section (e.g., upper ladder section 110) via a rotatable joint (e.g., a pin secured against lateral movement). Step rails 160 may be omitted or may optionally be provided for one or more ladder sections.

Step rails 160 may optionally be configured to ride on top of ladder rails 105, 106, comprising for example, a substantially planar or a U-shaped configuration adapted to mate with or abut against a front surface 107 of each ladder rail 105, 106 and link member 175 could be adapted to rotatably connect thereto, such as by a pin. In one aspect, the step sections corresponding to the ladder upper section 110 and middle section 120 (and lower section 140, if applicable) could be separated by elimination of a joint (i.e., 165) joining the step rails 160, so that the steps 150 may be operated in a discrete grouping corresponding to the ladder section. Such configuration would permit a slightly wider step 105, while retaining a minimized stack height, even though not all steps 150 could be simultaneously opened or closed a user would be required to separately deploy each set of steps. Still further, the separated step rails 160 could be automatically moved to deploy steps 150 upon unfolding of the section. This could be accomplished by utilizing hinge 400 shaft 410 to transmit a torque applied by a user to unfold the ladder sections (e.g., ladder sections 110, 120) to step rails 160 through one or more linkage members (not shown) and/or gears connected to the hinge 400 shaft 410. The linkage member(s), in one aspect, would be configured to produce an angular step rotation in proportion to a fraction of the rotation of the ladder rails 105, 106. For example, a 180° rotation of ladder rails 105, 106 could be used to effect a 135° rotation of steps 150.

In one aspect, such linkage member(s) is shown in FIGS. 19(*a*)–21(*d*), which show predominantly isometric views of a folding ladder 100 in accord with the present concepts in a variety of positions. The front view of FIG. 19(*c*) and isometric views of FIGS. 19(*a*)–(*b*), 19(*d*)–(*c*), 20(*a*)–(*d*), and 21(*a*)–(*d*) shows linkage members, discussed below, enabling automatic folding of the ladder steps upon rotation of the ladder in a closing direction. FIGS. 19(*a*)–21(*d*) omit some details for clarity. A first bracket 800 is attached to the right side rail 106 of the upper ladder section 110. Attached to bracket 800 is a first linkage member 805 connecting bracket 800 to the top step 150*a* of the middle ladder section 120. A second bracket 810 is attached to the left side rail 105 of the middle ladder section 120. A second linkage member 815 is attached to bracket 810 and connects the bracket to the bottom step 150*b* of the upper ladder section 110.

By connecting the upper ladder section 110 to the top step 150*a* of the middle ladder section 120 and the middle ladder section 120 to the bottom step 150*b* of the upper ladder section 100 in this manner, the steps 150*a* and 150*b* (and additional steps attached thereto by one or more additional linkage members) are forced to correspondingly open and close upon opening of and closure of adjacent ladder sections. A third linkage member 825 is attached between the left side bracket 810 and the top step 150*a* of the middle ladder section 120 to support the top step of the middle ladder section. Linkage member 825, in the illustrated configuration, does not contribute to the automatic rotation of the steps and may be optionally omitted or replaced by an equivalent member support the top step of the middle ladder section. As depicted in FIGS. 19(*a*)–21(*d*), the folding ladder 100 allows the steps 150 to automatically fold open and closed as the ladder is folded opened and closed, thus eliminating the need to fold the steps open before climbing the ladder and to eliminate the need to fold the steps closed before closing the ladder sections.

In another aspect of the above example eliminating step rail 160 joints 165, the step rails themselves could be omitted from one or more ladder sections (e.g., upper section 110, middle section 120, and/or lower section 140) in favor of alternative automatic step positioning systems. In one example of an alternative automatic step positioning system, a rack and pinion system could be disposed on an inner surface of ladder rails 105, 106 with a pinion connected to hinge 400 shaft 410 and a rack translatable linearly along a longitudinal axis of the ladder rails. The rack could simultaneously co-act with gears mated to each of the step bars 151. When rotation of the ladder sections is complete and the hinge 400 is locked, the pinion, rack, gears, and steps are also locked in place. The material, strength and duty ratings of the aforementioned pinion, rack, and gears would depend largely upon the step configurations and loads imposed by a user thereupon. The greater the potential torque that may be applied by a user stepping on a distal edge of the step, the higher the strength of the load bearing components must be to prevent component strain or failure. In one aspect, bar 151 may be disposed through a center of the step 150 to bi-sect the step and minimize torque. In another example of an alternative automatic step positioning system, a pulley system utilizing high tensile strength wire or cable (e.g., piano wire having a tensile strength of 3.0–5.5 (Scifer) GPa or high-strength (HS) or ultra high strength (UHS) carbon fiber having tensile strengths of between 2.8–5.2 GPa) could be disposed internally to ladder rails 105, 106 to the same effect as the aforementioned examples.

In the example illustrated in FIG. 15, the lower step 150*a* is pivotally connected, at a rear portion thereof, to the ladder rails 105, 106 by a bar 151 rotatably secured by conventional means within corresponding openings in the ladder rails. Lower step 150*a* is also rotatably connected, at a front portion thereof, to step rail 160 by a pinned joint 170. Step rail 160 is connected to another upper step rail 160 via joint 165. An inner side of the upper step rail 160 is rotatably connected to a front side portion of step 150*b* and an outer side of the upper step rail is rotatably connected to a link member 175. Link member 175 comprises a slot or track 176 within which a pin 180 inserted through or projecting from an inner surface of each side rail 105, 106 slides. Pin 180 comprises, in one aspect, a rivet or pin having a head with a diameter larger the slot width. In the opened or deployed position, wherein the steps are disposed at a desired attitude (e.g., horizontal) relative to the ground, pin 180 abuts against the upper terminus of slot 176 to prevent, in combination with the other linkages (e.g., step rail 160 and step 150) and fixed points (e.g., bar 151) in the mechanism, further rotation or translation of the link members 175. Link member 175 thus places a physical constraint on continued motion of step rail 160 and steps 150 in a downward direction and, as configured in one aspect, prevents downward motion of the steps beyond a position that is substantially horizontal to the ground.

Figure 16:
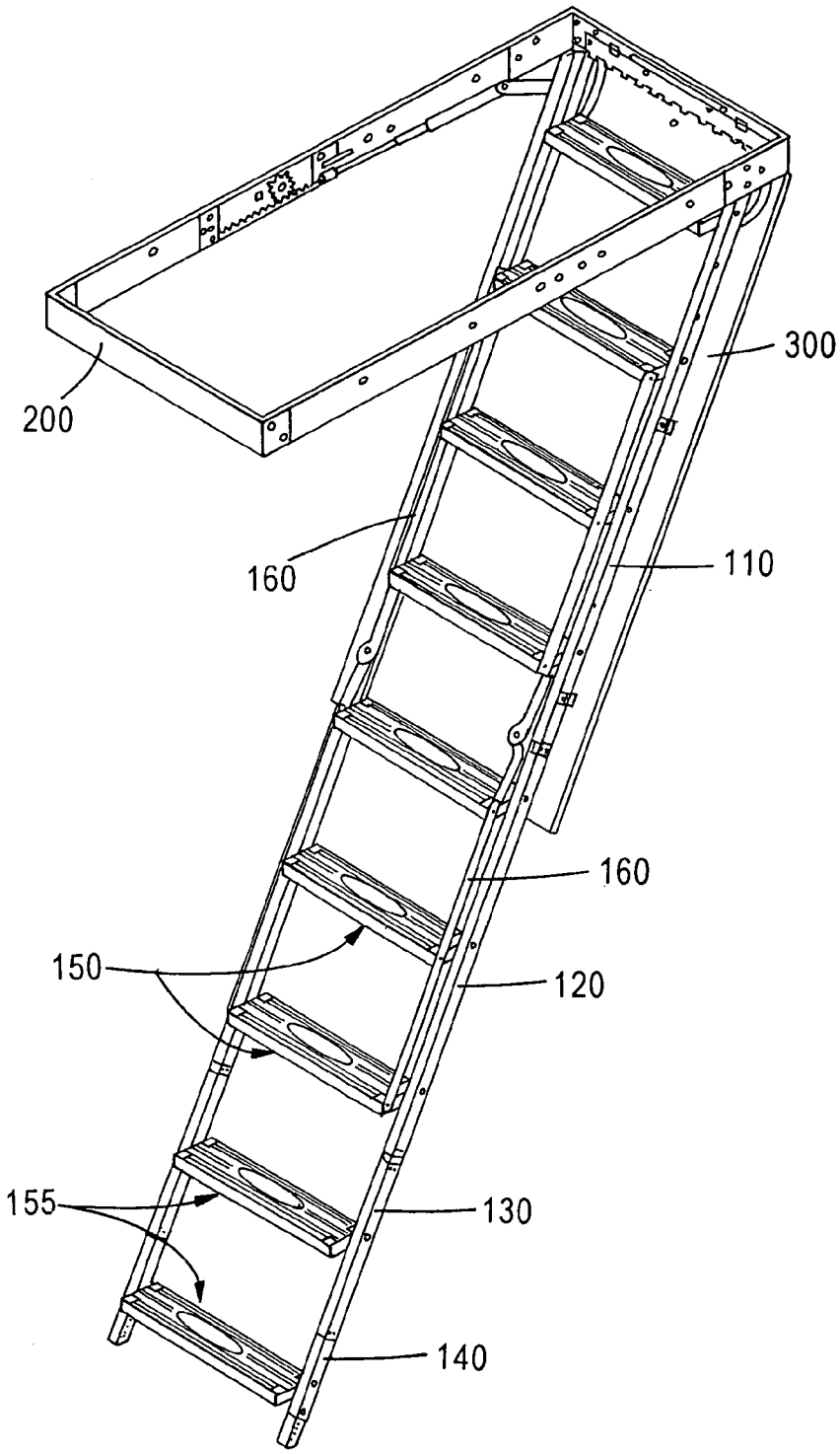
FIG. 16 is a top-perspective view of an unfolded folding ladder and support frame in accord with the present concepts.

FIG. 16 is a top-perspective view of an unfolded folding ladder and support frame with unfolded steps in accord with the present concepts.

Figure 17:
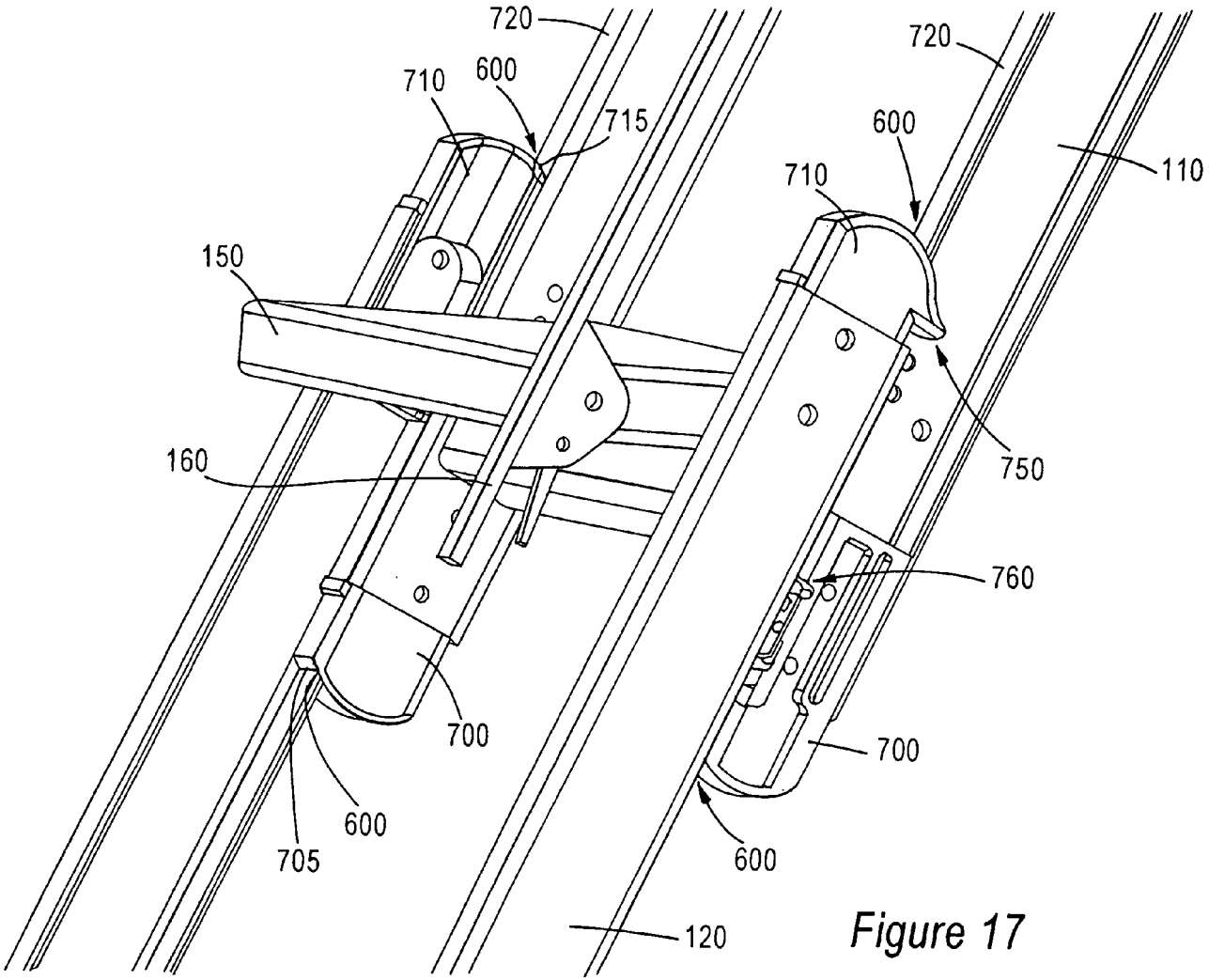
FIGS. 17–18 show views of another example of a stowable ladder including rotating and telescoping sections.
Figure 18:
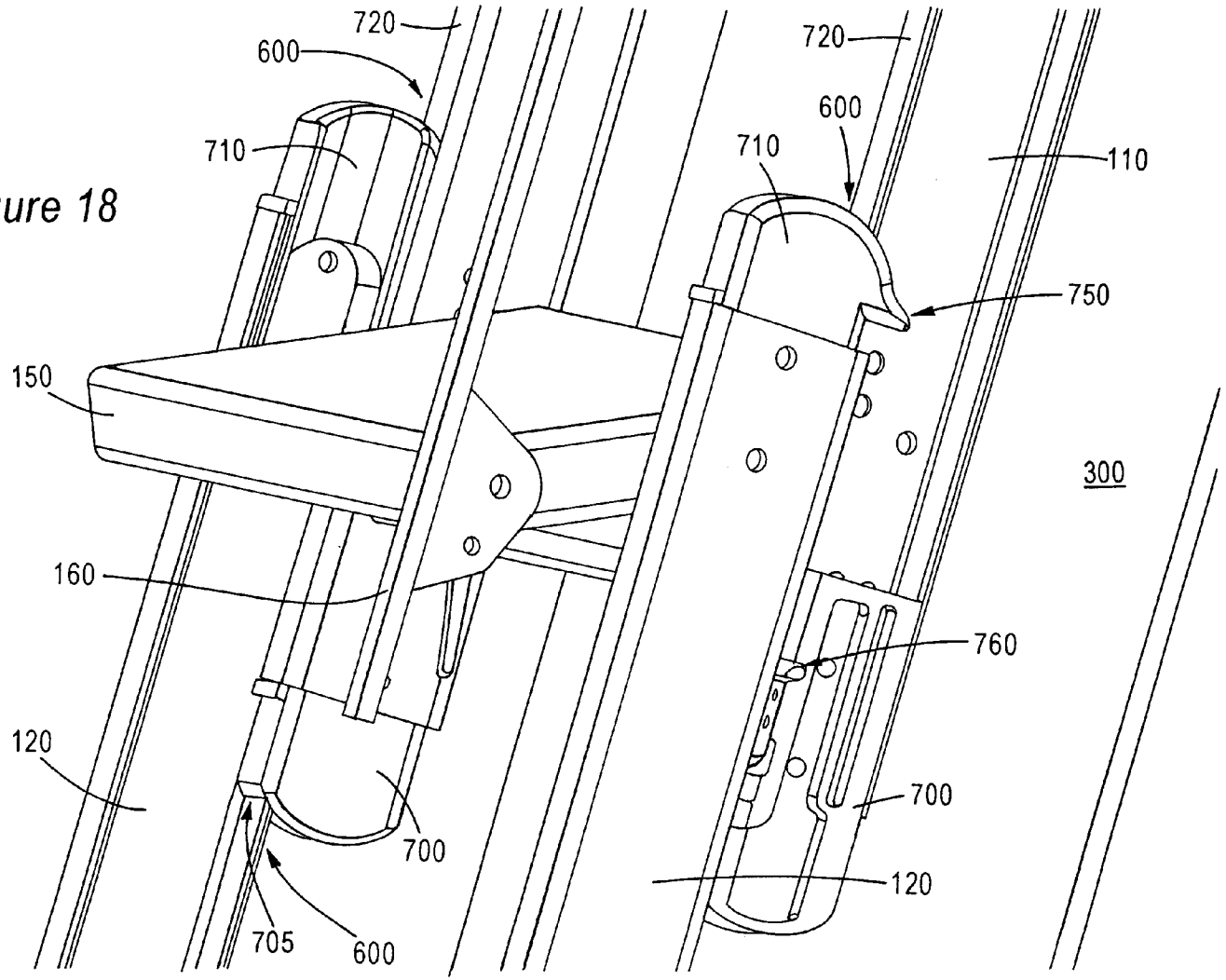
Figure 19B:
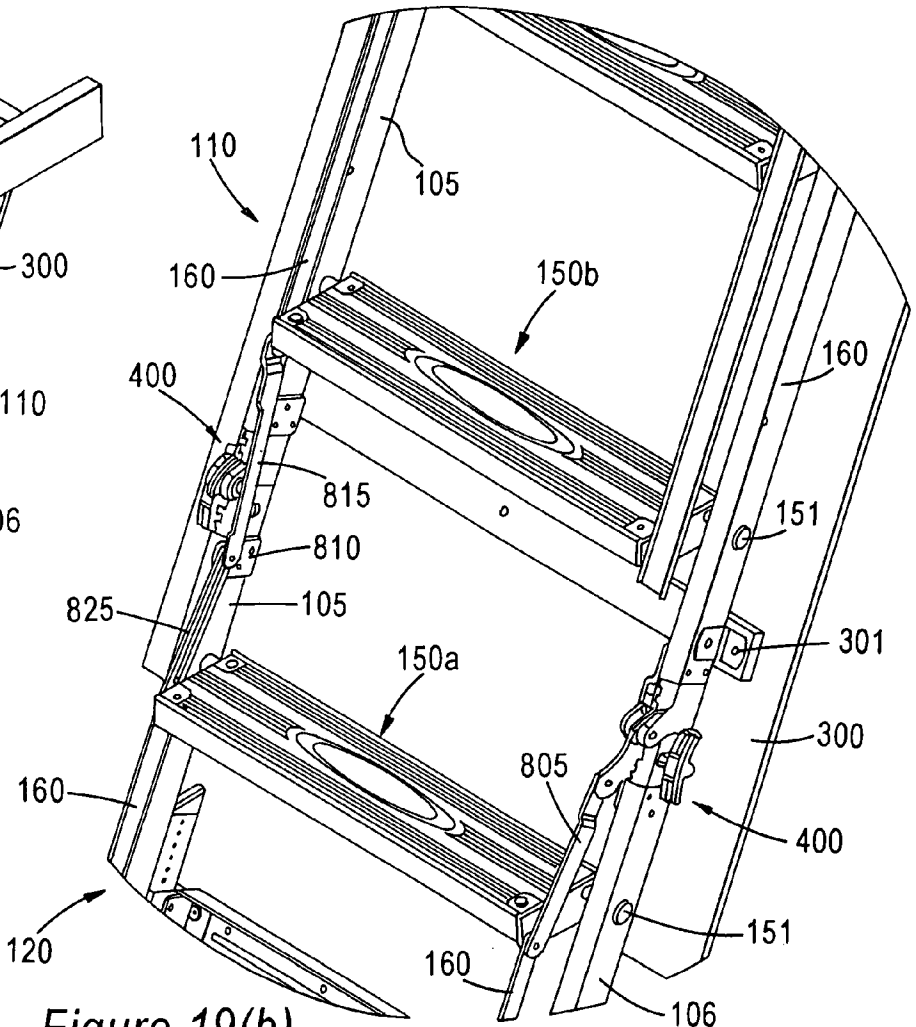
FIGS. 19(*a*)–(*b*) and 19(*d*)–(*e*) show isometric views and FIG. 19(*c*) shows a front view of one example of a folding ladder in accord with the present concepts in an open position showing linkage members enabling automatic folding of the ladder steps upon rotation of the ladder in a closing direction.
Figure 19A:
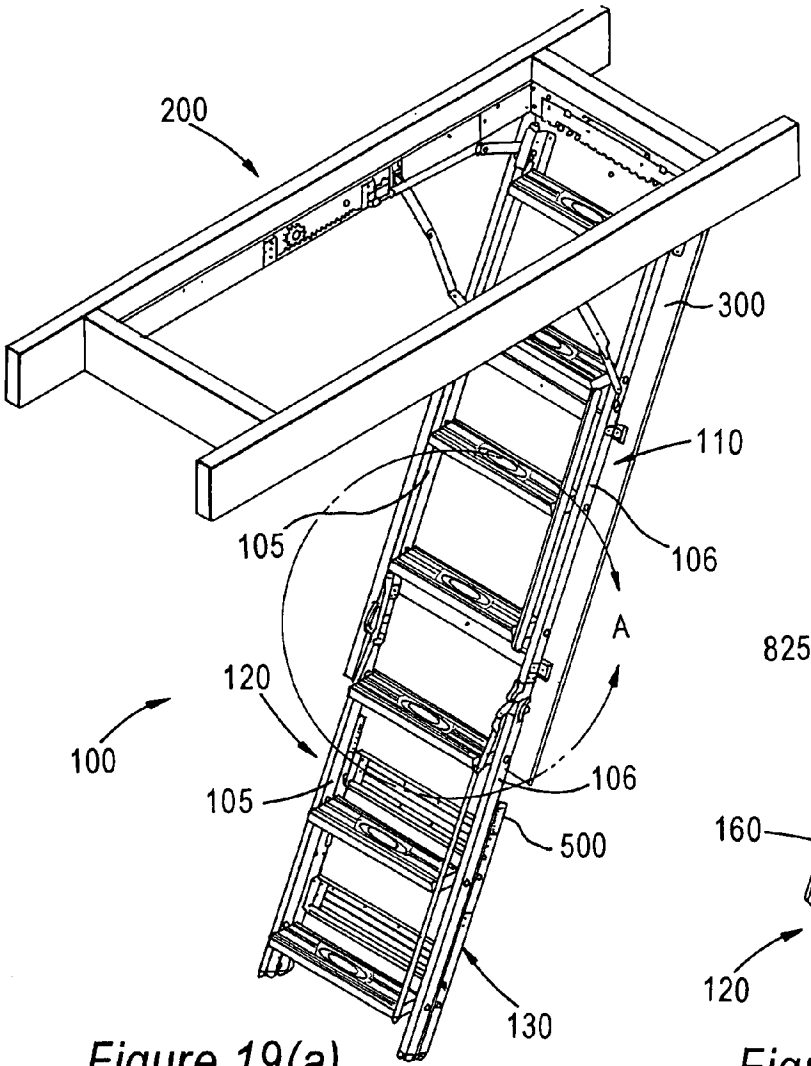
Figure 19C:
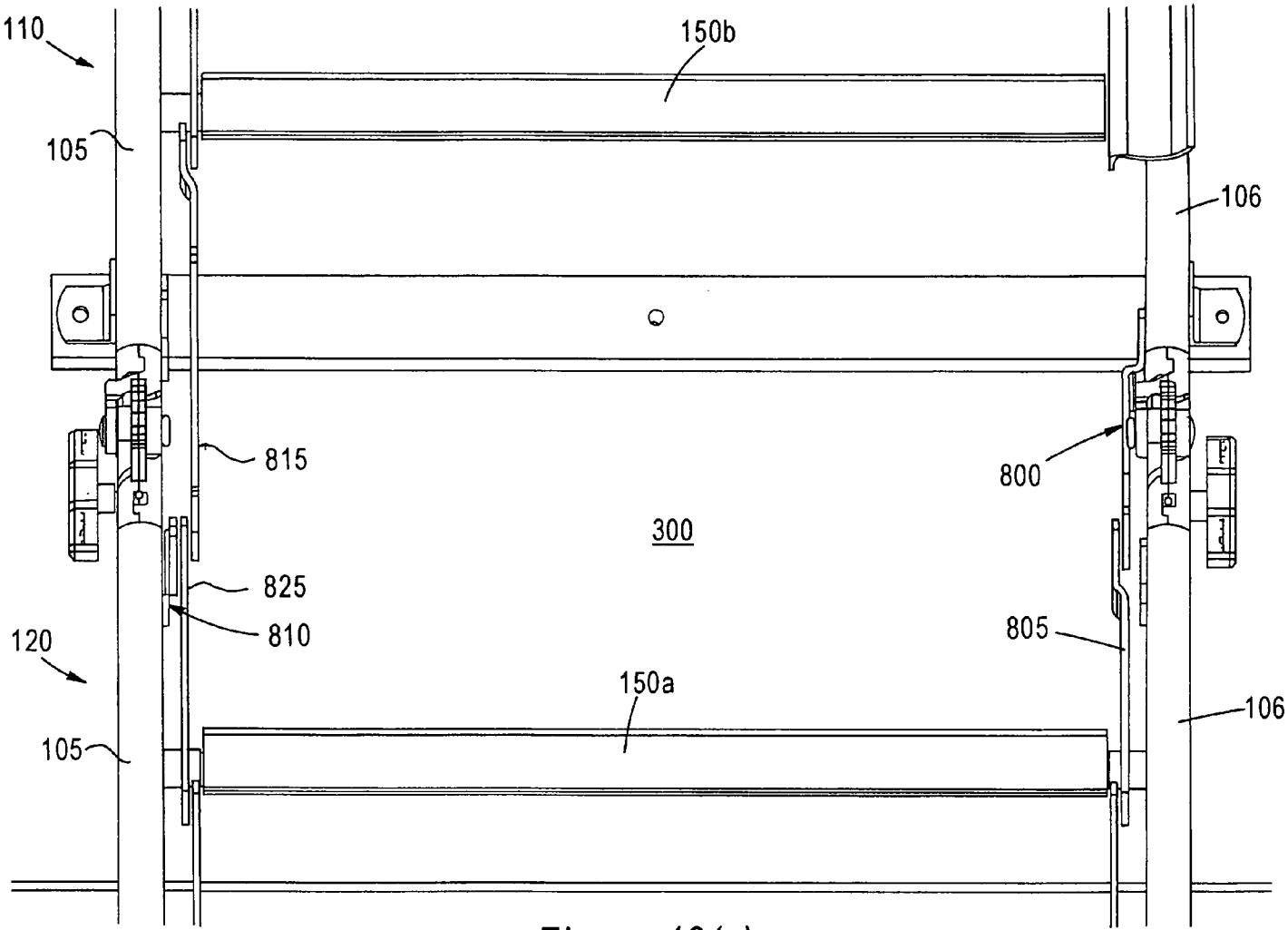
Figure 19D:
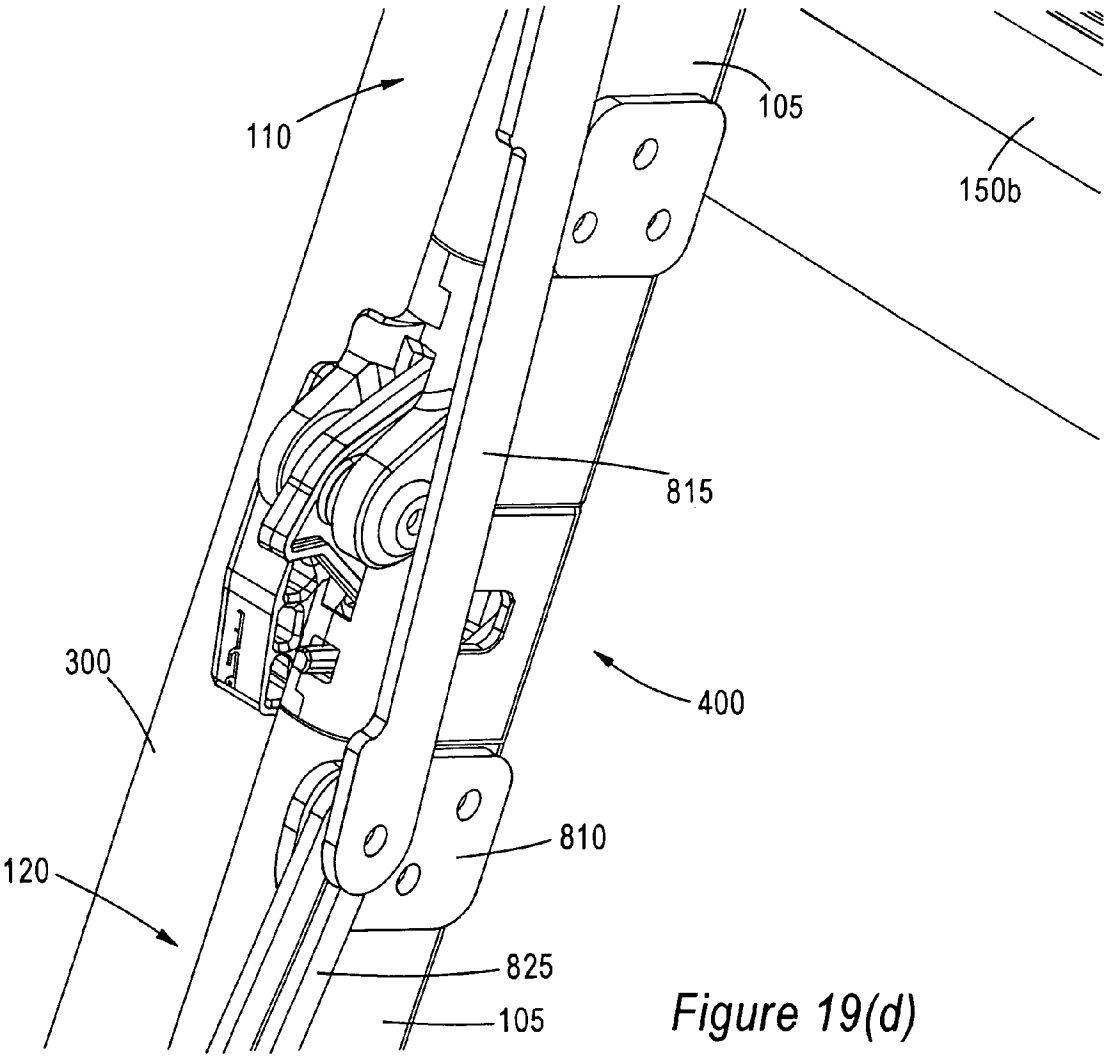
Figure 19E:
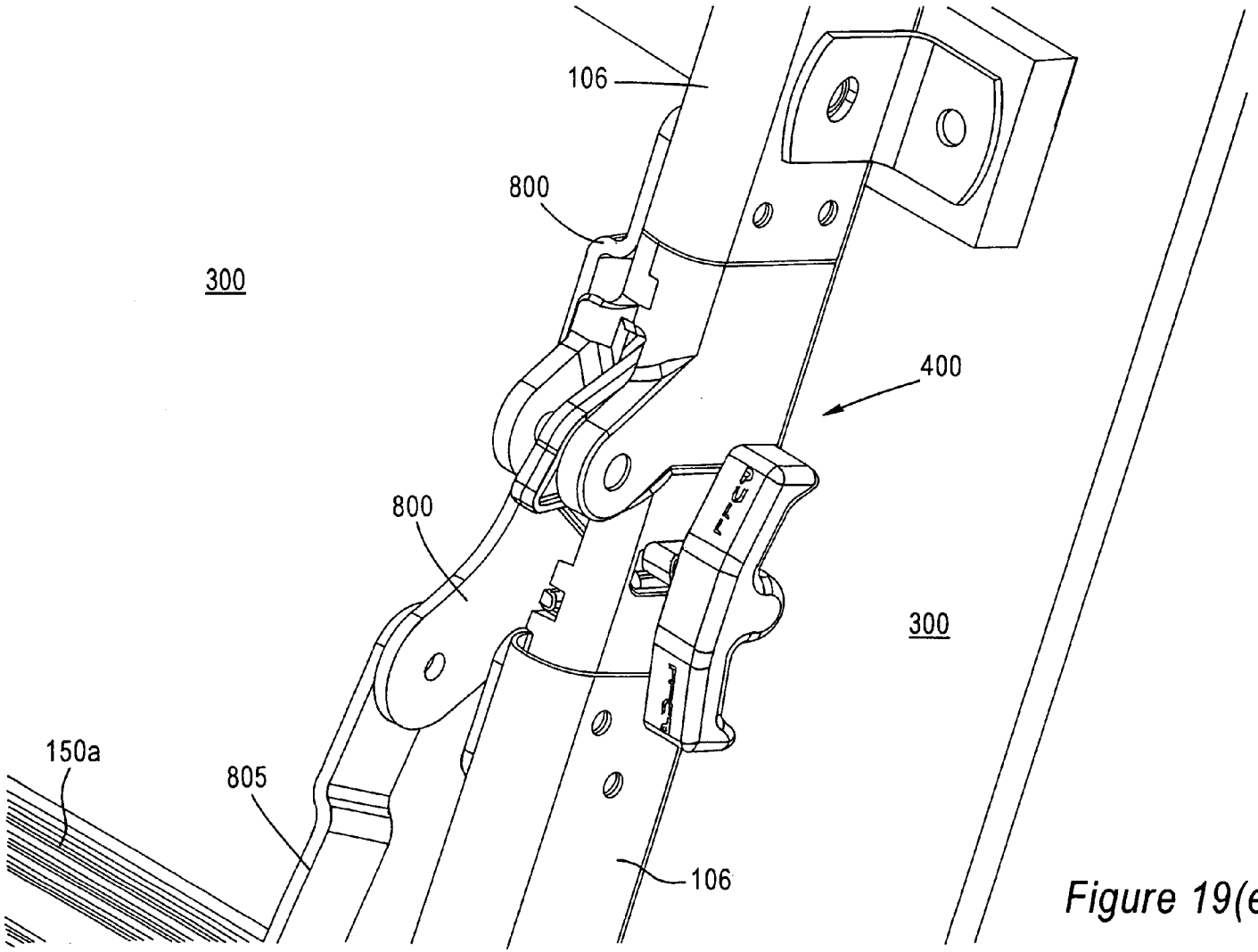
Figures 20A, 20B:
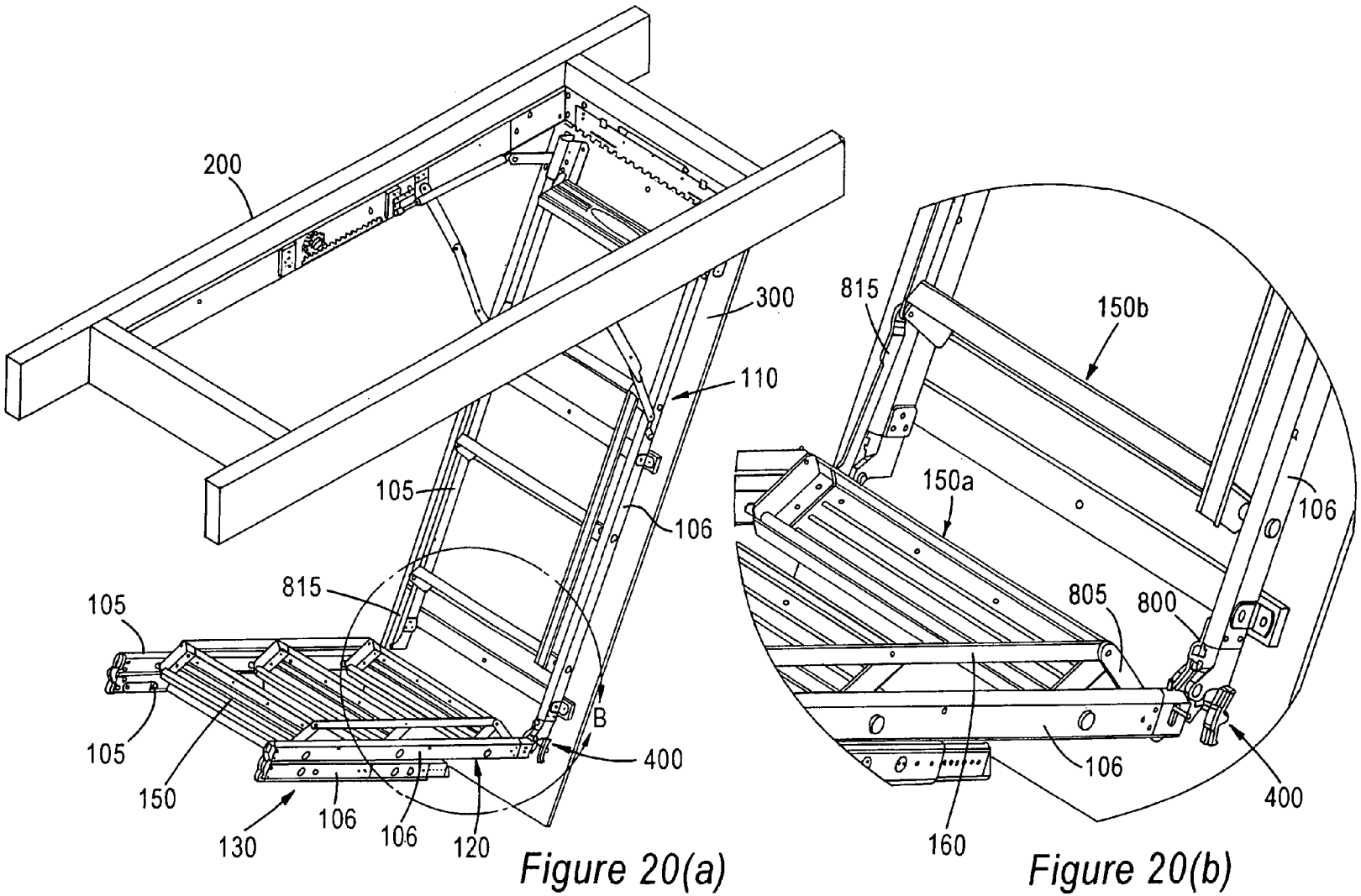
FIGS. 20(*a*)–(*d*) show isometric views for a folding ladder in accord with FIGS. 19(*a*)–(*d*) showing a state of linkage members during rotation of the ladder in a closing direction.
Figure 20C:
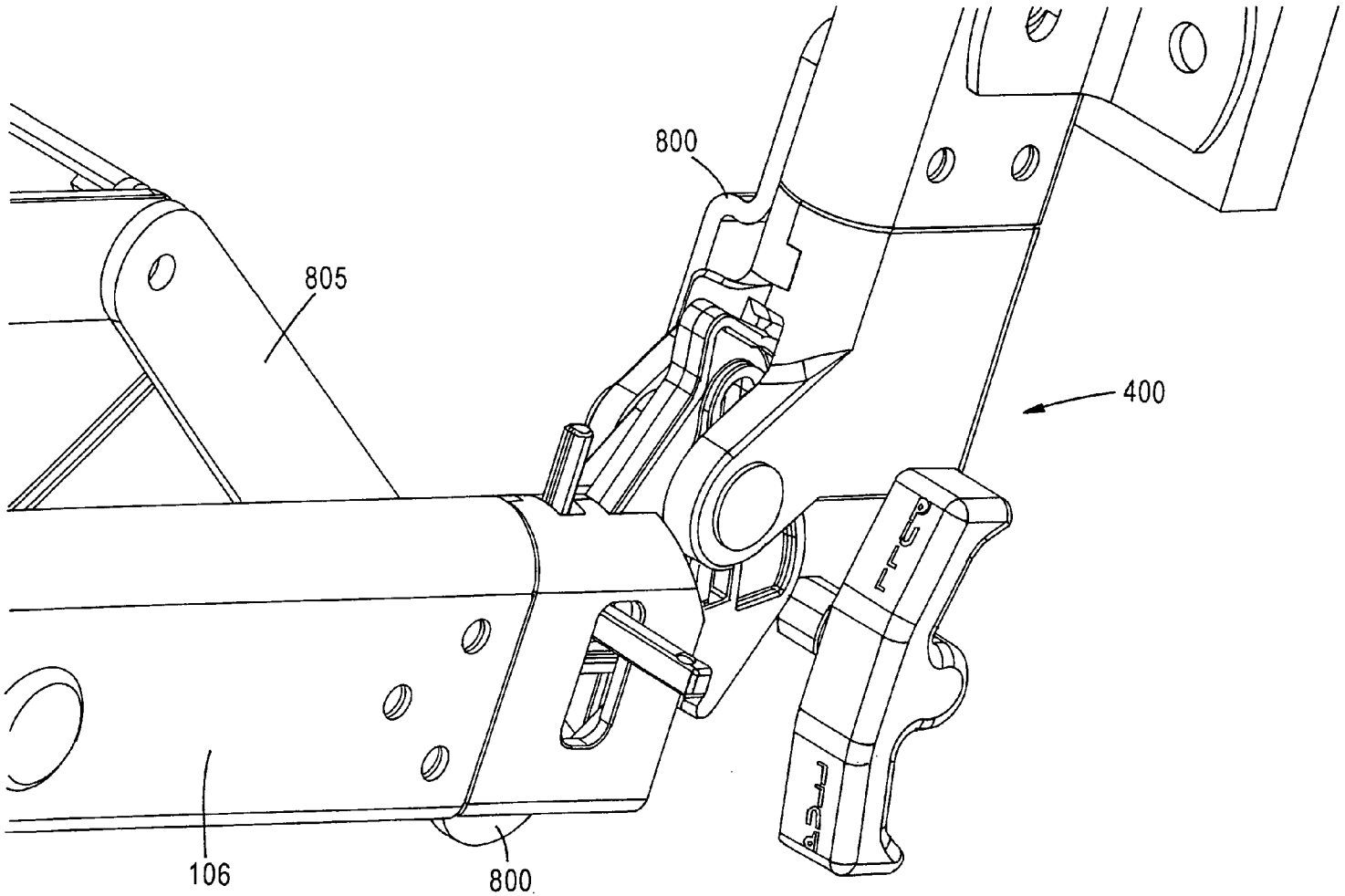
Figure 20D:
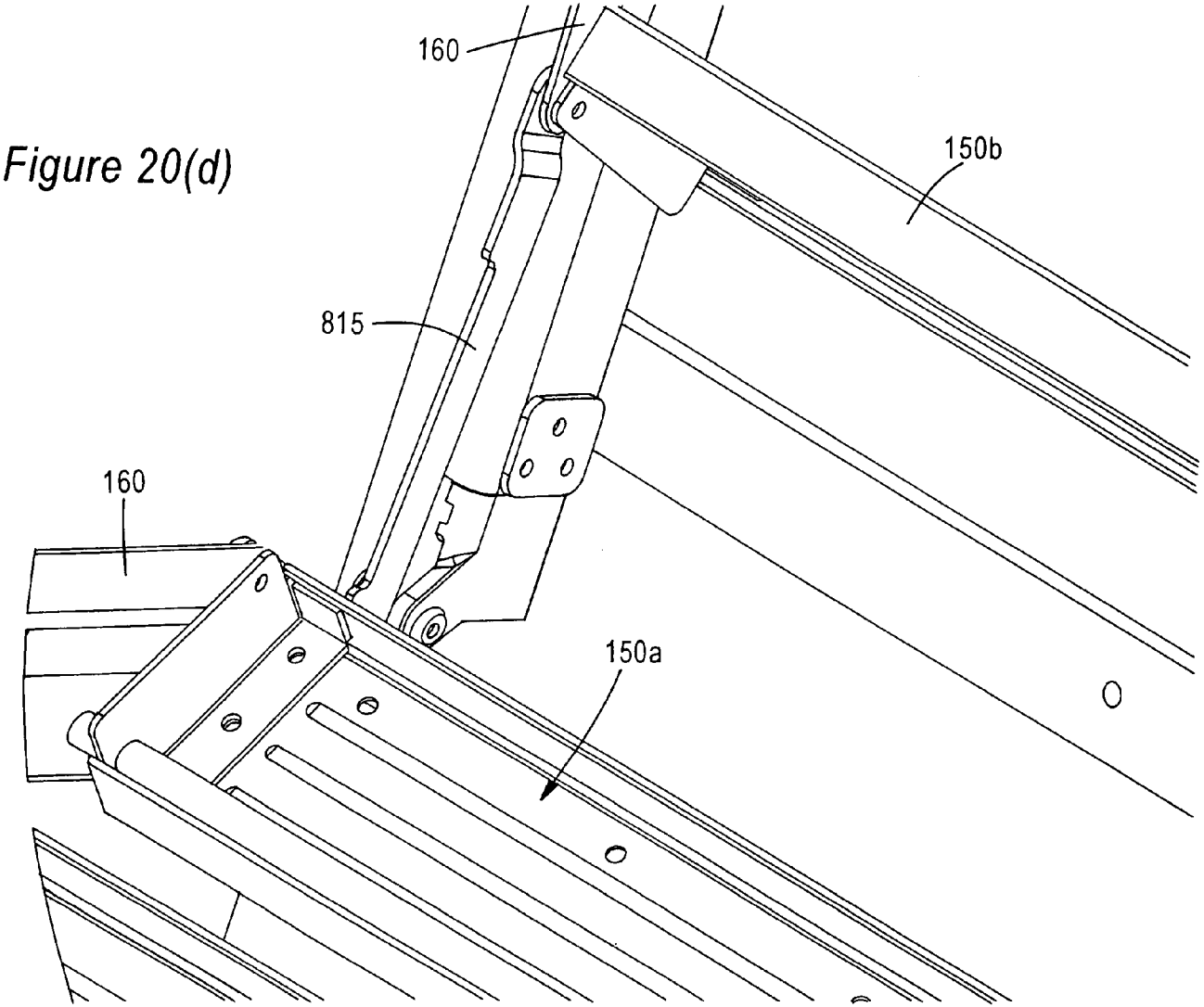
Figure 21B:
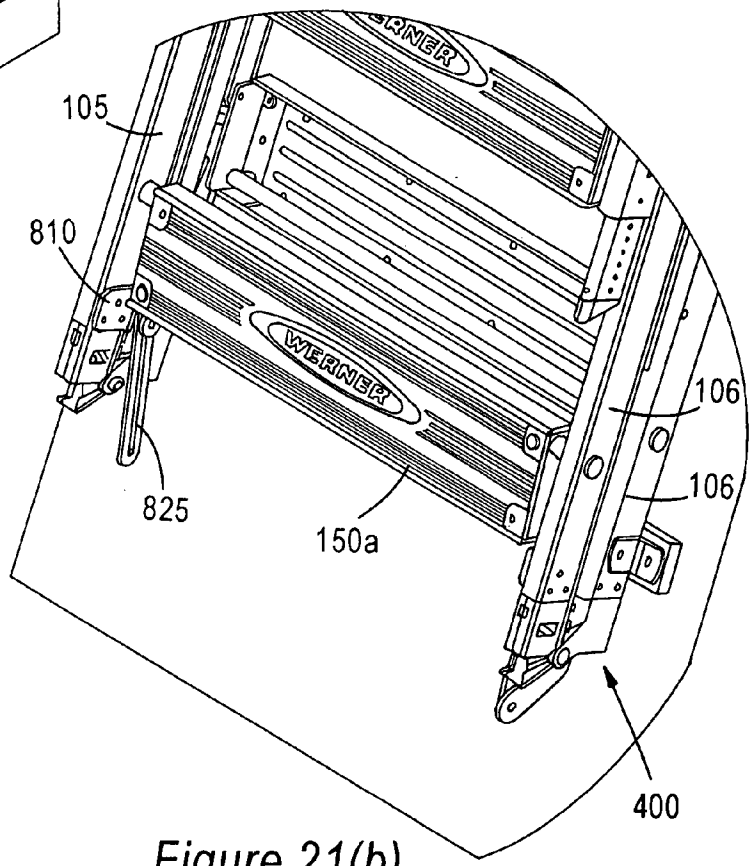
FIGS. 21 (*a*)–(*d*) show isometric views for a folding ladder in accord with FIGS. 19(*a*)–(*d*) showing a state of linkage members when a lower ladder section has been folded onto an upper ladder section.
Figure 21A:
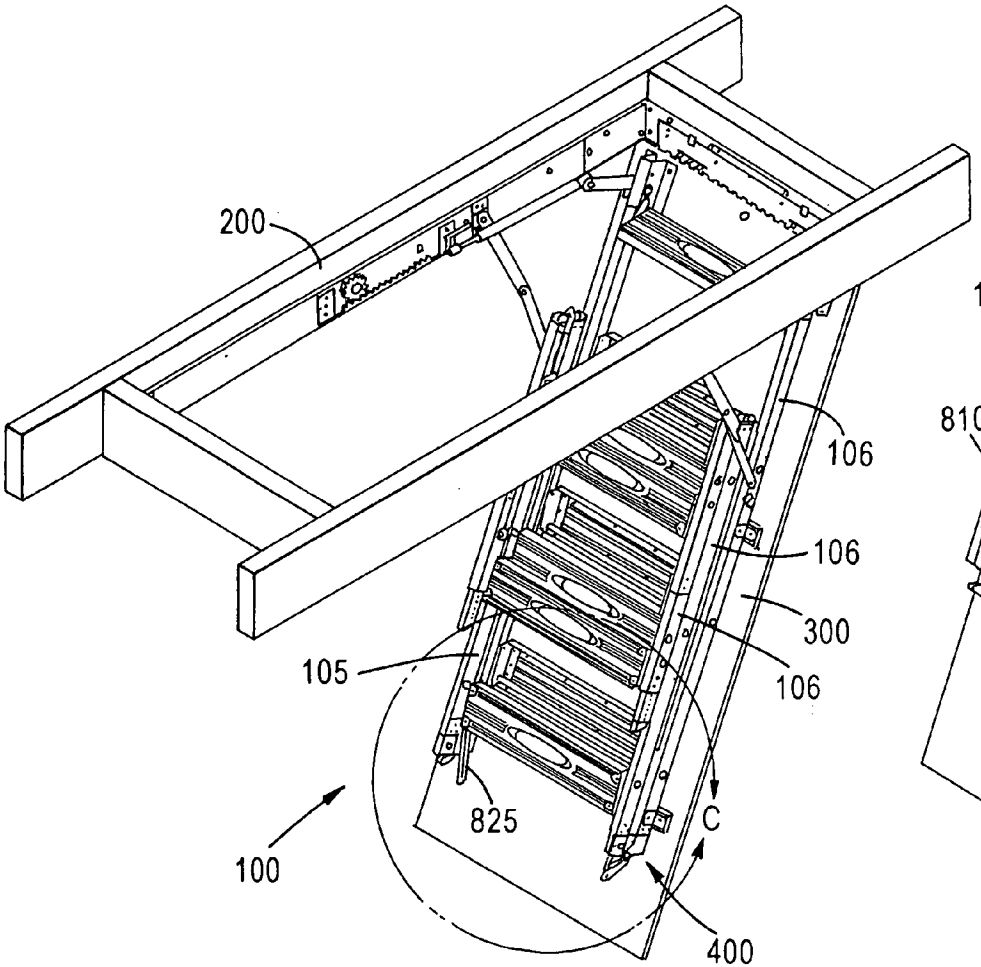
Figure 21C:
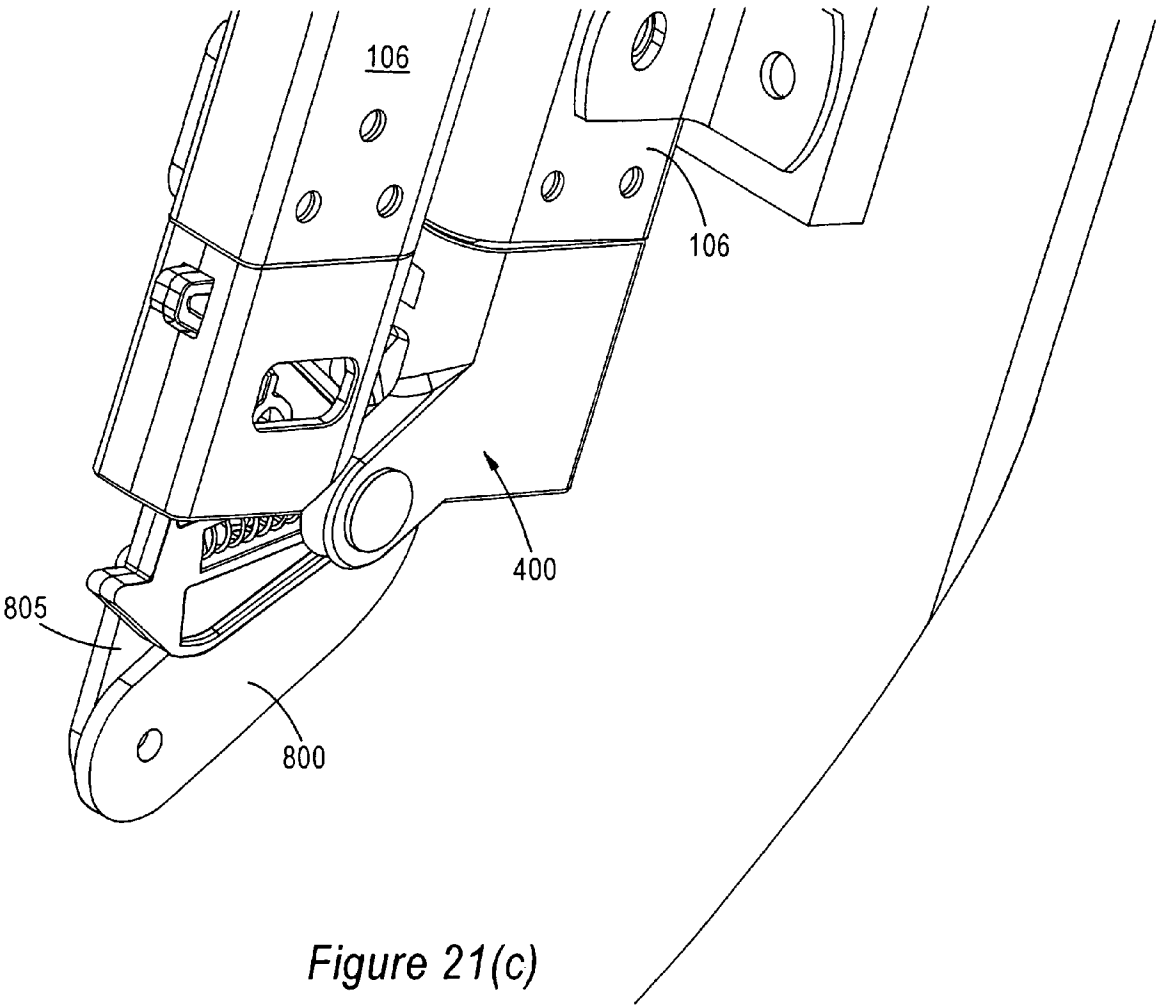
Figure 21D:
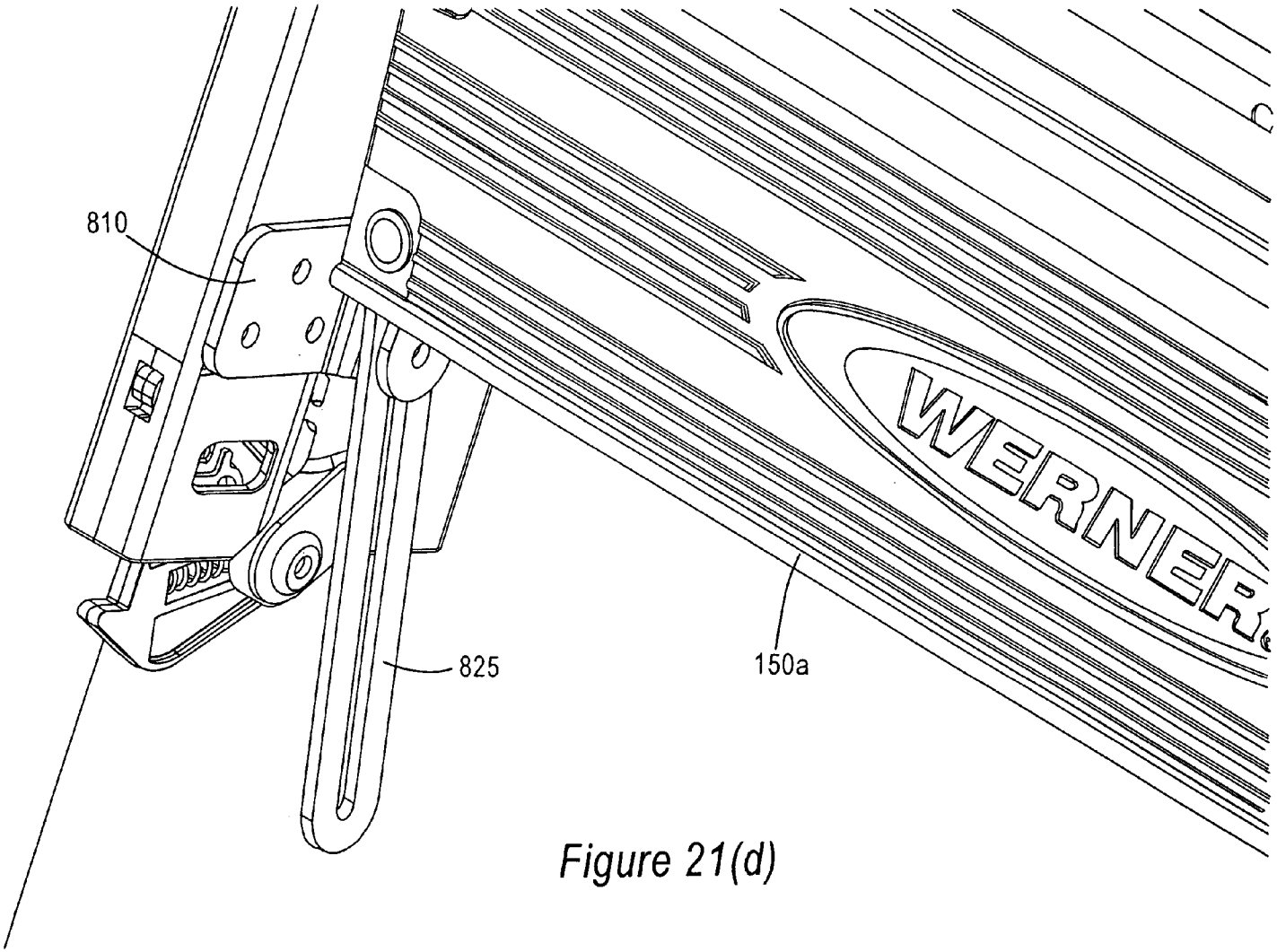

FIGS. 17–18 show views of telescoping upper and lower ladder sections, wherein the upper ladder rails (e.g., 110) and the lower ladder rails (e.g., 120) are configured to translate relative to one another by means of a translatable joint 600. Specifically, the lower ladder rails (e.g., 120) comprise an end cap 710 bearing either a protrusion or a recess configured to matingly engage or receive a respective one of a corresponding recess or protrusion on the upper ladder rails (e.g., 110). As shown, end cap 710 has a slot 715 which engages a rim or flange 720 of the upper ladder rail. Likewise, end cap 700 has a slot 705 which engages a rim or flange 730 of the lower ladder rail. End caps 700, 710 may themselves be formed of an acetal, such as Delrin®AF ($CF_{static}$=0.07, $CF_{dynamic}$=0.15), PTFE, nylon, polyethylene, or other durable low friction material. End caps 700, 710 may also be formed of a metal or composite comprising bearing a bearing member or surface formed of an acetal, PTFE, nylon, polyethylene, or other low friction material, configured to slide on the rim or flange 720, 730. Although the illustrated embodiment comprises two translatable joints 600 for each of the upper and lower ladder rail connections, one or more translatable joints can be provided in accord with the present concepts.

Alternate configurations could dispose protuding members on one ladder rail to slidingly mate within a C-channel formed in an opposing ladder rail. The sliding or telescoping motion may be facilitated by one or more bearing surfaces possessing a low coefficient of friction or having a low-friction coating applied thereto. For example, end caps 700, 710 comprise a protrusion, such as a pin or annular member, formed of an acetal, PTFE, nylon, polyethylene, or other low friction material, configured to slide within a corresponding groove formed in an upper ladder rail.

Still further, the sliding or telescoping motion may be facilitated by rollers provided on one of the middle ladder rails or the upper ladder rails. One or more rollers or bearing surfaces may be distributed along a length of the respective upper ladder rail and/or middle ladder rail, as necessary, to provide smooth movement of the ladder sections relative to one another. Any two ladder sections may be configured to telescope or translate with respect to one another. For example, a lowermost set of ladder rails may be configured to telescope with respect to a middle set of ladder rails or a plurality of pairs of ladder sections (e.g., three or more) may be configured to telescope or translate with respect to one another. Thus, in accord with the present concepts, a stowable ladder bearing one or more rotatable steps may include any number of ladder sections joining by any combination of rotatable joints (e.g., a hinge) and translatable joints 600 (e.g., a telescoping sections connected by bearing surface(s) or roller(s)).

Movement of one ladder section (e.g., 110) relative to another ladder section (e.g., 120) may be regulated by placement of stops (e.g., 750, 760) at selected locations. As shown in FIGS. 17–18, end caps 710, 700 themselves are formed with projecting stops 750, 760, respectively, which engage one another at a predefined limit of travel between the ladder rail sections. Stop 760 may be optionally adjusted relative to end cap 700, whereas stop 750 is shown to be fixed. Any manner of conventional fixed or adjustable stops may be used in combination with the disclosed invention.

In another configuration of telescoping upper and lower ladder sections, blocks of almost any solid material (e.g., Delrin®AF) may be used within or adjacent a track or groove provided to receive and stop a corresponding pin, protrusion, or roller element, for example, to thereby limit the range of travel of the translatable joint 600. The blocks may be positioned using any conventional fastening means, such as a mechanical connector (e.g., screw). In another example, rivets may be driven into predetermined locations on the track or groove. Further, the track or groove itself may be narrowed, gradually (e.g., linear or curved transition) or abruptly (e.g., crimping), at opposite ends to provide an impediment to travel of the cylindrical pin, annular member, or roller. A gradual, linear reduction in the dimension of one or more surfaces the track or groove would permit, for example, adjustment of the range of travel of the bearing member by selection of alternative bearing members having a smaller corresponding dimension.

The present disclosed herein can be practiced by employing conventional materials, methodology and equipment. Accordingly, the details of such materials, equipment and methodology are not set forth herein in detail. In the previous descriptions, numerous specific details of one preferred example, such as specific materials, structures, etc., are set forth to provide a grounding in the present concepts. However, it should be recognized that the present concepts can be practiced without resorting to the details specifically set forth. In other instances, well known processing structures have not been described in detail, in order not to unnecessarily obscure the present invention. It is to be understood that the present concepts are capable of use in various other combinations and environments and is capable of changes or modifications within the scope of the inventive concepts expressed herein.

We claim:

1. A folding ladder configured for installation in an opening to provide access between one floor or space and another floor or space, comprising:

an upper ladder section comprising a left ladder rail and a right ladder rail;

a lower ladder section comprising a left ladder rail and a right ladder rail;

a hinge rotatably connecting the upper ladder section left ladder rail to the lower ladder section left ladder rail and rotatably connecting the upper ladder section right ladder rail to the lower ladder section right ladder rail;

a plurality of steps rotatably disposed between the upper pair of ladder rails and the lower pair of ladder rails, the plurality of steps configured for rotation between a retracted position and a deployed position, wherein at least one step in the plurality of steps rotatably disposed between the upper pair of ladder rails and at least one step in the plurality of steps rotatably disposed between the lower pair of ladder rails are linked together by at least one linkage member, wherein said at least one linkage member causes each of said at least one steps to rotate between a retracted position and a deployed position upon rotational movement of said upper ladder section relative to said lower ladder section about said hinge between a closed position and an open position.

2. A foldable ladder configured for installation in an opening to provide access between one floor or space and another floor or space according to claim 1, wherein said at least one step in the plurality of steps rotatably disposed between the upper pair of ladder rails is linked to the remaining plurality of steps rotatably disposed between the upper pair of ladder rails, wherein said at least one step in the plurality of steps rotatably disposed between the lower pair of ladder rails is linked to the remaining plurality of steps rotatably disposed between the lower pair of ladder rails.

3. A foldable ladder configured for installation in an opening to provide access between one floor or space and another floor or space according to claim 2, wherein rotation of said at least one step in the plurality of steps rotatably disposed between the upper pair of ladder rails and said at least one step in the plurality of steps rotatably disposed between the lower pair of ladder rails causes a corresponding rotation of a respective one of said remaining plurality of steps rotatably disposed between the upper pair of ladder rails and said remaining plurality of steps rotatably disposed between the lower pair of ladder rails.

4. A foldable ladder configured for installation in an opening to provide access between one floor or space and another floor or space according to claim 3, wherein said rotation of said at least one step in the plurality of steps rotatably disposed between the upper pair of ladder rails and said at least one step in the plurality of steps rotatably disposed between the lower pair of ladder rails is caused by said at least one linkage member upon rotational movement of said upper ladder section relative to said lower ladder section.

5. A foldable ladder configured for installation in an opening to provide access between one floor or space and another floor or space according to claim 1, wherein said hinge is a locking hinge configured to lock in at least one position including a fully deployed position of the foldable ladder.

6. A foldable ladder configured for installation in an opening to provide access between one floor or space and another floor or space according to claim 1, wherein said hinge is configured to provide increased resistance to opening or closing at at least one angle along an arc traveled by the ladder including a fully deployed position of the foldable ladder.

7. A foldable ladder configured for installation in an opening to provide access between one floor or space and another floor or space according to claim 1, wherein in said retracted position the steps are positioned so that a front edge of the steps do not extend appreciably beyond a front edge of said ladder rails and a rear edge of the steps do not extend appreciably beyond a rear edge of said ladder rails.

8. A foldable ladder configured for installation in an opening to provide access between one floor or space and another floor or space according to claim 7, wherein in said deployed position the steps are positioned in a substantially horizontal position.

9. A foldable ladder configured for installation in an opening to provide access between one floor or space and another floor or space according to claim 1, wherein said at least one linkage member comprises:

a first bracket disposed on said upper ladder section right ladder rail;

a second bracket disposed on said lower ladder section left ladder rail;

a first linkage member connecting the first bracket to a topmost step in the lower ladder section; and a second linkage member connecting the second bracket to a lowermost step in the upper ladder section.

10. A foldable ladder configured for installation in an opening to provide access between one floor or space and another floor or space according to claim 9, further comprising:

a third linkage member connecting the second bracket and a step in the lower ladder section.

11. A foldable ladder configured for installation in an opening to provide access between one floor or space and another floor or space according to claim 9, further comprising:

a third linkage member connecting the second bracket and a topmost step in the lower ladder section.

* * * * *